US009860967B2

(12) United States Patent
Hosoda et al.

(10) Patent No.: US 9,860,967 B2
(45) Date of Patent: Jan. 2, 2018

(54) TARGET SUPPLY APPARATUS, EXTREME ULTRAVIOLET LIGHT GENERATING APPARATUS, AND TARGET SUPPLY METHOD

(71) Applicant: Gigaphoton Inc., Tochigi (JP)

(72) Inventors: Hirokazu Hosoda, Oyama (JP); Tsukasa Hori, Oyama (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 15/210,296

(22) Filed: Jul. 14, 2016

(65) Prior Publication Data

US 2016/0323986 A1 Nov. 3, 2016

Related U.S. Application Data

(63) Continuation of application No. PCT/JP2014/058344, filed on Mar. 25, 2014.

(51) Int. Cl.
*H05G 2/00* (2006.01)

(52) U.S. Cl.
CPC ..... *H05G 2/008* (2013.01); *H05G 2/006* (2013.01)

(58) Field of Classification Search
None
See application file for complete search history.

(56) References Cited

U.S. PATENT DOCUMENTS

2013/0221246 A1* 8/2013 Hori ..... H05G 2/005 250/504 R
2014/0138560 A1* 5/2014 Umeda ..... H05G 2/005 250/504 R
2014/0138561 A1* 5/2014 Umeda ..... H05G 2/006 250/504 R
2014/0375974 A1* 12/2014 Yakunin ..... G03F 7/70033 355/67

FOREIGN PATENT DOCUMENTS

JP 2923100 B2 * 7/1999 ..... G21B 1/15
JP 2010199560 A * 9/2010 ..... H05G 2/003
JP 2013-175402 A 9/2013
JP 2013175402 A * 9/2013 ..... H05G 2/005

OTHER PUBLICATIONS

International Search Report issued in PCT/JP2014/058344; dated Jun. 3, 2014.
Written Opinion issued in PCT/JP2014/058344; dated Jun. 3, 2014.

* cited by examiner

*Primary Examiner* — Andrew Smyth
(74) *Attorney, Agent, or Firm* — Studebaker & Brackett PC

(57) ABSTRACT

A target supply apparatus configured to melt a target and supply a molten target into a chamber, the target generating extreme ultraviolet light when the target is irradiated with a laser beam in the chamber, may include: a pair of electrodes spaced from one another and configured to sandwich the target; and a power source configured to supply a current to a solid target sandwiched between the pair of electrodes via the pair of electrodes to melt the solid target to a core of the solid target.

19 Claims, 20 Drawing Sheets

| TARGET MATERIAL | MELTING POINT (°C) | ELECTRIC RESISTIVITY ($\mu\Omega \cdot m$) | HEAT CONDUCTIVITY @300K ($W \cdot m^{-1} \cdot K^{-1}$) | MAGNETISM |
|---|---|---|---|---|
| Gd | 1312 | 1.31 | 10.6 | PARAMAGNETISM FERROMAGNETISM (20°C OR LOWER) |
| Tb | 1356 | 1.15 | 11.1 | PARAMAGNETISM FERROMAGNETISM (−52°C OR LOWER) |
| Fe | 1538 | $96.1 \times 10^{-3}$ | 80.4 | FERROMAGNETISM (1043K) |
| Mo | 2896 | $53.4 \times 10^{-3}$ | 138 | PARAMAGNETISM |

*FIG.18 A*

| ELECTRODE MATERIAL | | MELTING POINT(°C) | MAGNETISM |
|---|---|---|---|
| STAINLESS | SUS304 | 1,400～1,450 | NONMAGNETISM |
| | SUS316 | 1,371～1,400 | NONMAGNETISM |
| | SUS444 | 1,430～1,510 | FERROMAGNETISM |
| | SUS329J4L | 1,420～1,462 | MAGNETISM |
| COPPER | Cu | 1084.62 | DIAMAGNETISM |
| ALUMINUM | Al | 660.32 | PARAMAGNETISM |
| TUNGSTEN | W | 3422 | PARAMAGNETISM |
| NIOBIUM | Nb | 2477 | PARAMAGNETISM |
| HAFNIUM | Hf | 2233 | PARAMAGNETISM |
| TANTALUM | Ta | 3017 | PARAMAGNETISM |
| MOLYBDENUM | Mo | 2896 | PARAMAGNETISM |
| CHROMIUM | Cr | 1907 | DIAMAGNETISM |
| GRAPHITE | C | 3000 | DIAMAGNETISM |

*FIG.18 B*

TARGET SUPPLY APPARATUS, EXTREME ULTRAVIOLET LIGHT GENERATING APPARATUS, AND TARGET SUPPLY METHOD

CROSS-REFERENCES TO RELATED APPLICATIONS

This application claims the benefit of International Patent Application No. PCT/JP2014/058344 filed Mar. 25, 2014, which is incorporated herein by reference.

BACKGROUND

1. Technical Field

The present disclosure relates to a target supply apparatus and a target supply method.

2. Related Art

In recent years, as semiconductor processes become finer, transfer patterns for use in photolithographies of semiconductor processes have rapidly become finer. In the next generation, microfabrication at 70 nm to 45 nm, further, microfabrication at 32 nm or less would be demanded. In order to meet the demand for microfabrication at 32 nm or less, for example, it is expected to develop an exposure device in which a system for generating extreme ultraviolet (EUV) light at a wavelength of approximately 13 nm is combined with a reduced projection reflective optical system.

Three types of EUV light generation systems have been proposed, which include an LPP (laser produced plasma) type system using plasma generated by irradiating a target material with a laser beam, a DPP (discharge produced plasma) type system using plasma generated by electric discharge, and an SR (synchrotron radiation) type system using synchrotron orbital radiation.

CITATION LIST

Patent Literature

PTL1: Japanese Patent Application No. 2012-040182

PTL2: Japanese Patent No. 2923100

SUMMARY

According to an aspect of the present disclosure, a target supply apparatus configured to melt a target and supply a molten target into a chamber, the target generating extreme ultraviolet light when the target is irradiated with a laser beam in the chamber, may include: a pair of electrodes spaced from one another and configured to sandwich the target; and a power source configured to supply a current to a solid target sandwiched between the pair of electrodes via the pair of electrodes to melt the solid target to a core of the solid target.

According to an aspect of the present disclosure, a target supply method for supplying a target into a chamber, the target generating extreme ultraviolet light when being irradiated with a laser beam, may include: transferring a solid target to between a pair of electrodes spaced from one another to sandwich the solid target between the pair of electrodes so that the solid target contacts the pair of electrodes; supplying a current to the solid target sandwiched between the pair of electrodes via the pair of electrodes; and melting the solid target sandwiched between the pair of electrodes to a core of the solid target.

BRIEF DESCRIPTION OF THE DRAWINGS

Hereinafter, selected embodiments of the present disclosure will be described with reference to the accompanying drawings by way of example.

FIG. 18A is a drawing explaining materials for forming a target supplied by an eleventh example of the target supply apparatus;

FIG. 18B is a drawing explaining materials for forming the pair of electrodes of the eleventh example of the target supply apparatus;

DESCRIPTION OF EXEMPLARY EMBODIMENTS

<Contents>

Figure 1:
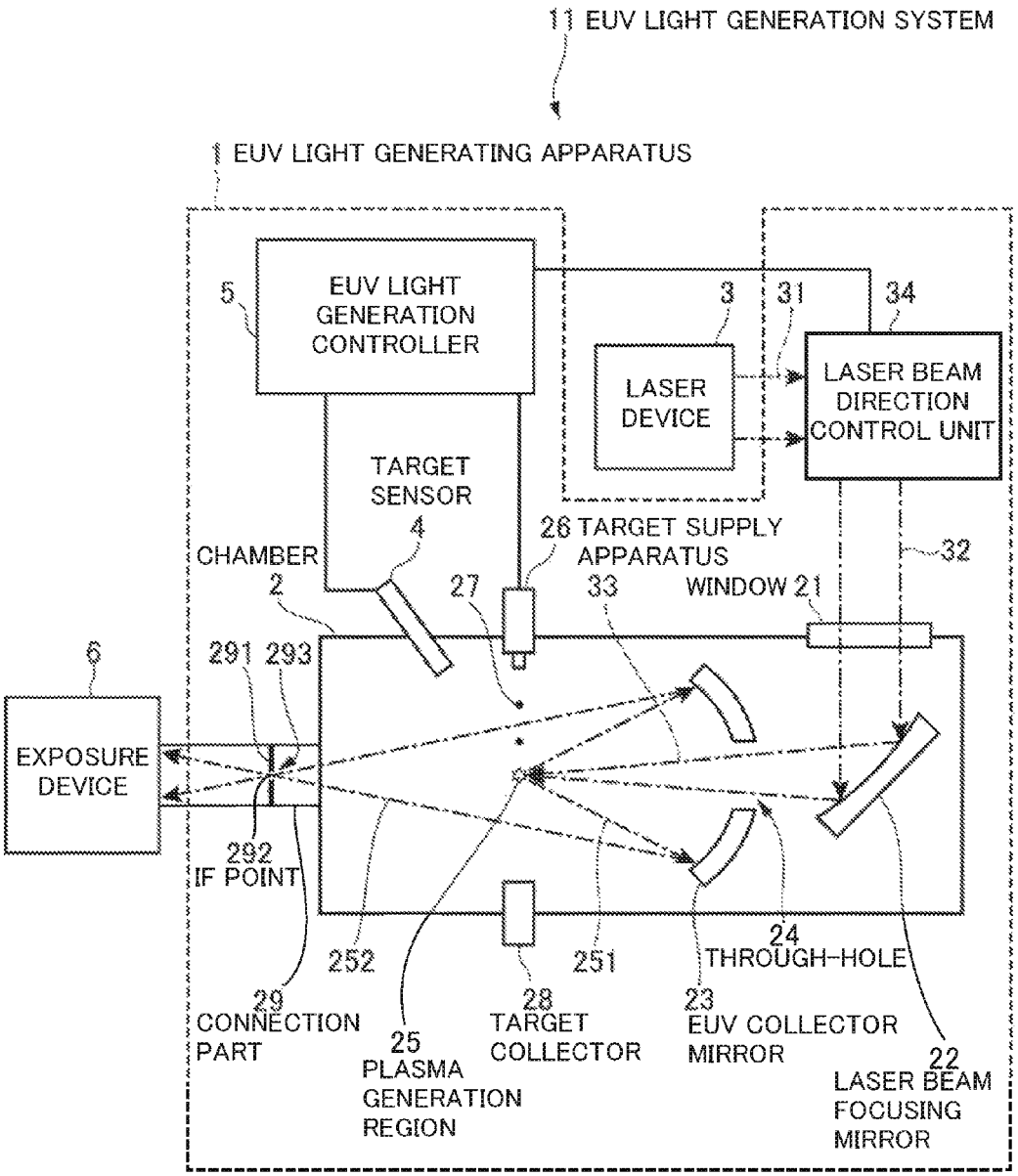
FIG. 1 schematically shows an exemplary configuration of an LPP type EUV light generation system.

1. Overview
2. Description of terms
3. Overview of the EUV light generation system
3.1 Configuration
3.2 Operation
4. Target supply apparatus
4.1 Basic configuration
4.2 Principle of operation
4.3 Detailed configuration
4.4 Operation
4.5 Problem
5. Target supply apparatus according to Embodiment 1
5.1 First example of the target supply apparatus
5.2 Second example of the target supply apparatus
6. Target supply apparatus according to Embodiment 2
6.1 Third example of the target supply apparatus
6.2 Fourth example of the target supply apparatus
7. Target supply apparatus according to Embodiment 3
7.1 Fifth example of the target supply apparatus
7.2 Sixth example of the target supply apparatus
7.3 Seventh example of the target supply apparatus
7.4 Eighth example of the target supply apparatus
8. Target supply apparatus according to Embodiment 4
8.1 Ninth example of the target supply apparatus
9. Target supply apparatus according to Embodiment 5
9.1 Tenth example of the target supply apparatus
10. Target supply apparatus according to Embodiment 6
10.1 Eleventh example of the target supply apparatus
11. EUV light generating apparatus including the target supply apparatus
11.1 Configuration
11.2 Operation
12. Others
12.1 Hardware environment of each controller
12.2 Other modification Hereinafter, selected embodiments of the present disclosure will be described in detail with reference to the accompanying drawings. The embodiments to be described below are merely illustrative in nature and do not limit the scope of the present disclosure. Further, the configuration(s) and operation(s) described in each embodiment are not all essential in implementing the present disclosure. Moreover, corresponding components may be referenced by corresponding reference numerals and characters, and therefore duplicate descriptions will be omitted.

1. Overview

The present disclosure may disclose at least the following embodiments.

A target supply apparatus 26 configured to melt a target 27 and supply a molten target into a chamber 2, the target 27 generating extreme ultraviolet light when the target 27 is irradiated with a laser beam 33 in the chamber 2, may include: a pair of electrodes 710 spaced from one another and configured to sandwich the target 27; and a power source 72 configured to supply a current to a solid target 27 sandwiched between the pair of electrodes 710 via the pair of electrodes 710 to melt the solid target 27 to a core of the solid target 27.

With this configuration, the target supply apparatus 26 can stably supply the target 27 with low power consumption, low costs, and a simple device configuration.

2. Description of Terms

"Target" refers to a substance which is introduced into the chamber and is irradiated with a laser beam. The target irradiated with the laser beam is turned into plasma and emits EUV light. "Droplet" refers to one form of the target introduced into the chamber.

3. Overview of the EUV Light Generation System 3.1 Configuration

FIG. 1 schematically shows the configuration of an exemplary LPP type EUV light generation system. An EUV light generating apparatus 1 may be used with at least one laser device 3. In the present disclosure, the system including the EUV light generating apparatus 1 and the laser device 3 is referred to as an EUV light generation system 11. As shown in FIG. 1, and as described in detail later, the EUV light generating apparatus 1 may include the chamber 2 and the target supply apparatus 26. The chamber 2 may be sealed airtight. The target supply apparatus 26 may be mounted onto the chamber 2, for example, to penetrate a wall of the chamber 2. A target material to be supplied from the target supply apparatus 26 may include, but is not limited to, tin, lithium, terbium, gadolinium, iron, molybdenum, or a combination of any two or more of them.

The chamber 2 may have at least one through-hole in its wall. A window 21 may be provided in the through-hole. A pulsed laser beam 32 outputted from the laser device 3 may transmit through the window 21. In the chamber 2, an EUV collector mirror 23 having a spheroidal reflective surface may be provided. The EUV collector mirror 23 may have a first focusing point and a second focusing point. The surface of the EUV collector mirror 23 may have a multi-layered reflective film in which layers such as molybdenum layers and silicon layers are alternately laminated. The EUV collector mirror 23 may be arranged such that the first focusing point is positioned in a plasma generation region 25 and the second focusing point is positioned in an intermediate focusing (IF) point 292. The EUV collector mirror 23 may have a through-hole 24 formed at the center thereof so that a pulsed laser beam 33 may pass through the through-hole 24.

The EUV light generating apparatus 1 may further include an EUV light generation controller 5 and a target sensor 4. The target sensor 4 may have an imaging function and detect the presence, trajectory, position, speed and so forth of the target 27.

Further, the EUV light generating apparatus 1 may include a connection part 29 that allows the interior of the chamber 2 to be in communication with the interior of an exposure device 6. In the connection part 29, a wall 291 having an aperture 293 may be provided. The wall 291 may be positioned such that the second focusing point of the EUV collector mirror 23 lies in the aperture 293.

The EUV light generating apparatus 1 may also include a laser beam direction control unit 34, a laser beam focusing mirror 22, and a target collector 28 for collecting the target 27. The laser beam direction control unit 34 may include an optical element for defining the traveling direction of the laser beam and an actuator for adjusting the position and the posture of the optical element.

3.2 Operation

With reference to FIG. 1, a pulsed laser beam 31 outputted from the laser device 3 may pass through the laser beam direction control unit 34, transmit through the window 21 as a pulsed laser beam 32, and then enter the chamber 2. The pulsed laser beam 32 may travel through the chamber 2 along at least one laser beam path, be reflected from the laser beam focusing mirror 22, and be applied to at least one target 27 as a pulsed laser beam 33.

The target supply apparatus 26 may be configured to output the target 27 to the plasma generation region 25 in the chamber 2. The target 27 may be irradiated with at least one pulse of the pulsed laser beam 33. Upon being irradiated with the pulsed laser beam, the target 27 may be turned into plasma, and EUV light 251 may be emitted from the plasma together with the emission of light at different wavelengths. The EUV light 251 may be selectively reflected from the EUV collector mirror 23. EUV light 252 reflected from the EUV collector mirror 23 may be focused onto the IF point 292, and outputted to the exposure device 6. Here, one target 27 may be irradiated with multiple pulses of the pulsed laser beam 33.

The EUV light generation controller 5 may be configured to totally control the EUV light generation system 11. The EUV light generation controller 5 may be configured to process the image data of the target 27 captured by the target sensor 4. Further, the EUV light generation controller 5 may be configured to control at least one of: the timing at which the target 27 is outputted; and the direction in which the target 27 is outputted. Furthermore, the EUV light generation controller 5 may be configured to control at least one of: the timing at which the laser device 3 performs an oscillation operation; the traveling direction of the pulsed laser beam 32; and the position on which the pulsed laser beam 33 is focused. The various controls described above are merely examples, and other controls may be added as necessary.

4. Target Supply Apparatus 4.1 Basic Configuration

Figure 2:
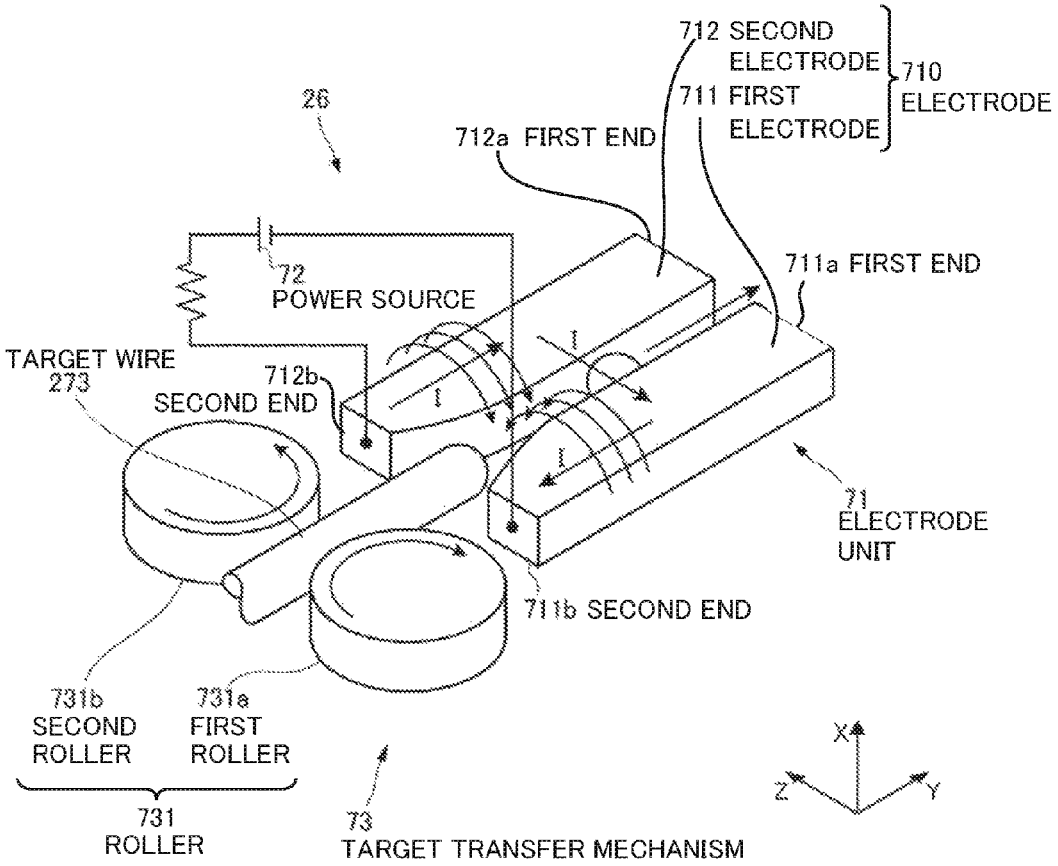
FIG. 2 shows the basic configuration of a target supply apparatus.
Figure 3A:
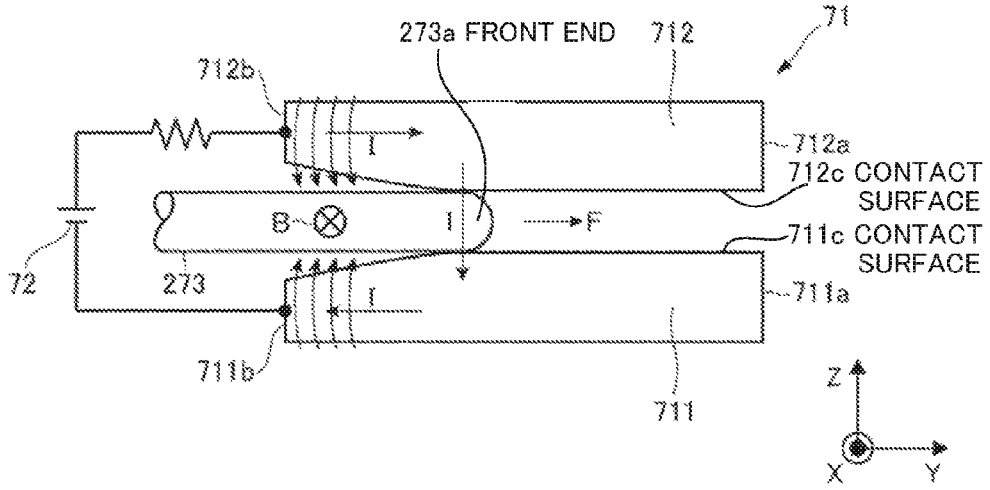
FIG. 3A shows a drawing explaining the principle of the operation of the target supply apparatus, where a target sandwiched between a pair of electrodes is in a solid state.
Figure 3B:
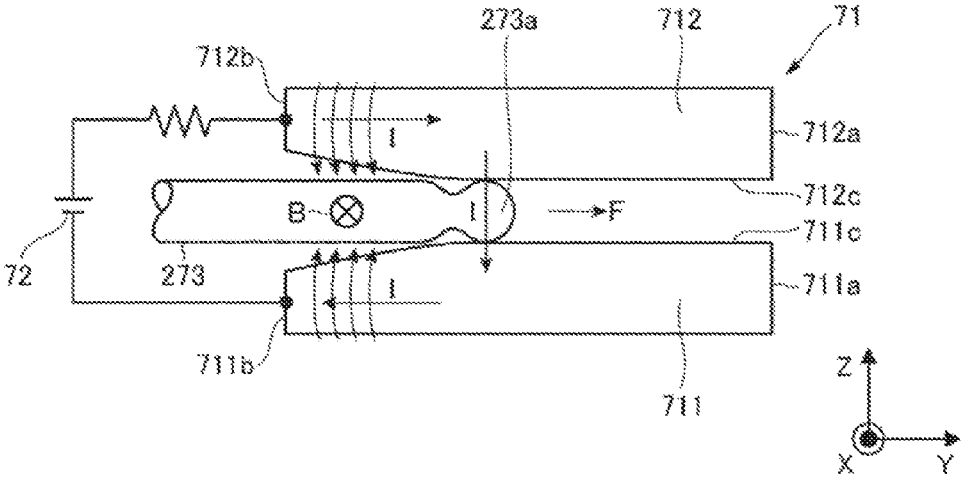
FIG. 3B is a drawing explaining the principle of the operation of the target supply apparatus, where the target sandwiched between the pair of electrodes is being molten.
Figure 3C:
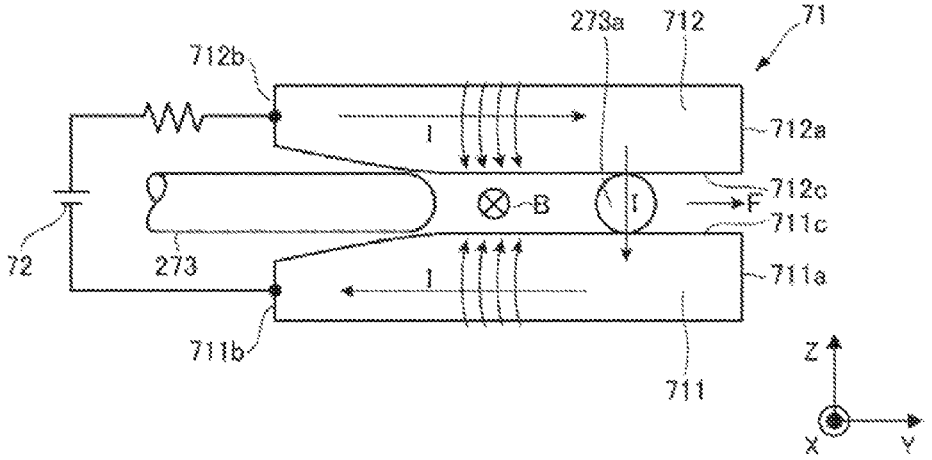
FIG. 3C is a drawing explaining the principle of the operation of the target supply apparatus, where the target sandwiched between the pair of electrodes has been molten.

With reference to FIGS. 2 to 3C, the basic configuration and the principle of the operation of the target supply apparatus 26 will be described. FIG. 2 is a drawing explaining the basic configuration of the target supply apparatus 26. In FIG. 2, a direction in which the target 27 is ejected from between the electrodes 710 is defined as a Y-axis direction. An X-axis direction and a Z-axis direction are orthogonal to the Y-axis direction and are orthogonal to one another. The same applies to the subsequent drawings.

The target supply apparatus 26 may be configured to melt the target 27 and supply the molten target 27 into the chamber. In the chamber 2, when being irradiated with the pulsed laser beam 33, the target 27 generates the EUV light 252. The target 27 may be a metallic material. As described above, the target 27 may include tin, terbium, gadolinium, iron, molybdenum, or a combination of any two or more of them. The diameter of the target 27 supplied into the chamber 2 may be, for example, 20 μm to 30 μm. The velocity of the target 27 supplied into the chamber 2 may be, for example, 60 m/s to 100 m/s. The output frequency of the target 27 supplied into the chamber 2 may be, for example, 50 kHz to 100 kHz. The target supply apparatus 26 may include an electrode unit 71, a power source 72, and a target transfer mechanism 73.

The electrode unit 71 may include a pair of electrodes 710. The pair of electrodes 710 may be formed as rails. The pair of electrodes 710 may include a first electrode 711 and a second electrode 712. The first electrode 711 and the second electrode 712 may be made of a conductive material. Each of the first electrode 711 and the second electrode 712 may be formed in a rod shape having a rectangular cross-section. The first electrode 711 and the second electrode 712 may be disposed in parallel with one another. A first end 711*a* of the first electrode 711 and a first end 712*a* of the second electrode 712 may be disposed to face the plasma generation region 25 in the chamber 2. The distance between a second end 711*b* of the first electrode 711 and a second end 712*b* of the second electrode 712 may be wider than the distance between the first end 711*a* and the first end 712*a*. The target 27 may be sandwiched between the first electrode 711 and the second electrode 712. A surface 711*c* of the first electrode 711 facing the second electrode 712 and a surface 712*c* of the second electrode 712 facing the first electrode 711 may be contact surfaces in contact with the target 27.

The target transfer mechanism 73 may include a pair of rollers 731. The pair of rollers 731 may be composed of a first roller 731*a* and a second roller 731*b*. The target 27 may be sandwiched between the first roller 731*a* and the second roller 731*b*. The target 27 sandwiched between the first roller 731*a* and the second roller 731*b* may be a solid. This solid target 27 may be a target wire 273 which is a wire-like target. The first roller 731*a* and the second roller 731*b* may be rotated by driving a motor 736 described later.

The rollers 731 may transfer the target wire 273 to the region between the second end 711*b* of the first electrode 711 and the second end 712*b* of the second electrode 712 by a predetermined amount. The target wire 273 transferred by the rollers 731 may be sandwiched between the first electrode 711 and the second electrode 712 while contacting the contact surface 711*c* of the first electrode 711 and the contact surface 712*c* of the second electrode 712. In other words, the pair of electrodes 710 may sandwich the target wire 273 between the contact surface 711*c* and the contact surface 712*c* of the pair of electrodes 710.

The power source 72 may supply a current to the target 27 sandwiched between the pair of electrodes 710 via the pair of electrodes 710. The power source 72 may be a voltage source. The power source 72 may include a cathode terminal and an anode terminal (not shown). The cathode terminal and the anode terminal of the power source 72 may be connected to the second end 711*b* of the first electrode 711 and the second end 712*b* of the second electrode 712 of the pair of electrodes 710, respectively. The power source 72 may apply a voltage to between the pair of electrodes 710 through the cathode terminal and the anode terminal, and therefore supply a current to the target 27 sandwiched between the pair of electrodes 710. The current supplied from the power source 72 may be a direct current. The current supplied from the power source 72 may be a constant current.

4.2 Principle of Operation

FIGS. 3A to 3C are drawings explaining the principle of the operation of the target supply apparatus 26. FIG. 3A is a drawing explaining the principle of the operation of the target supply apparatus 26, where the target 27 sandwiched between the pair of electrodes 710 is in a solid state. FIG. 3B is a drawing explaining the principle of the operation of the target supply apparatus 26, where the target 27 sandwiched between the pair of electrodes 710 is being molten. FIG. 3C is a drawing explaining the principle of the operation of the target supply apparatus 26, where the target 27 sandwiched between the pair of electrodes 710 has been molten.

As shown in FIG. 3A, the target wire 273 transferred from the target transfer mechanism 73 may be sandwiched between the pair of electrodes 710. When a front end 273*a* of the target wire 273 contacts the contact surfaces 711*c* and 712*c* of the pair of electrodes 710, a current path may be defined by the pair of electrodes 710, the front end 273*a*, and the power source 72. The power source 72 may apply a voltage to the pair of electrodes 710 to flow a current through the current path.

When a current flows through the current path defined by the pair of electrodes 710, the front end 273*a* of the target wire 273, and the power source 72, a magnetic field can be formed around the current path, in accordance with Ampere's circuital law, as shown in FIG. 3A. This magnetic field may appear, in particular, between the pair of electrodes 710 as a strong magnetic field. Moreover, when a current flows through the current path, Joule heat may be generated in the current path. The Joule heat generated in each section of the current path may be proportional to the electric resistance of each section of the current path. When the target wire 273 has a higher electric resistance than that of the pair of electrodes 710, the temperature of the target wire 273 may be increased locally at the front end 273*a*, and therefore the front end 273*a* may be molten.

In addition, the front end 273*a* of the target wire 273 may be subjected to a Lorentz force in the direction indicated by an arrow F, which is induced by the magnetic field and the current flowing through the front end 273*a* of the target wire 273, in accordance with Fleming's left-hand rule. With this Lorentz force, the molten front end 273*a* of the target wire 273 may be pulled and therefore extended as shown in FIG. 3B.

When the molten front end 273*a* of the target wire 273 is further pulled, at least a part of the molten front end 273*a* may be separated from the remaining part of the target wire 273 due to the surface tension, as shown in FIG. 3C. The separated front end 273*a* may be further accelerated by the Lorentz force corresponding to the magnitude of the current and also the magnitude of the magnetic field. The accelerated front end 273*a* may be ejected from the first ends 711*a* and 712*a* of the pair of electrodes 710 while maintaining its momentum. After that, the front end 273*a* ejected from between the pair of electrodes 710 may travel toward the chamber 2.

4.3 Detailed Configuration

Figure 4A:
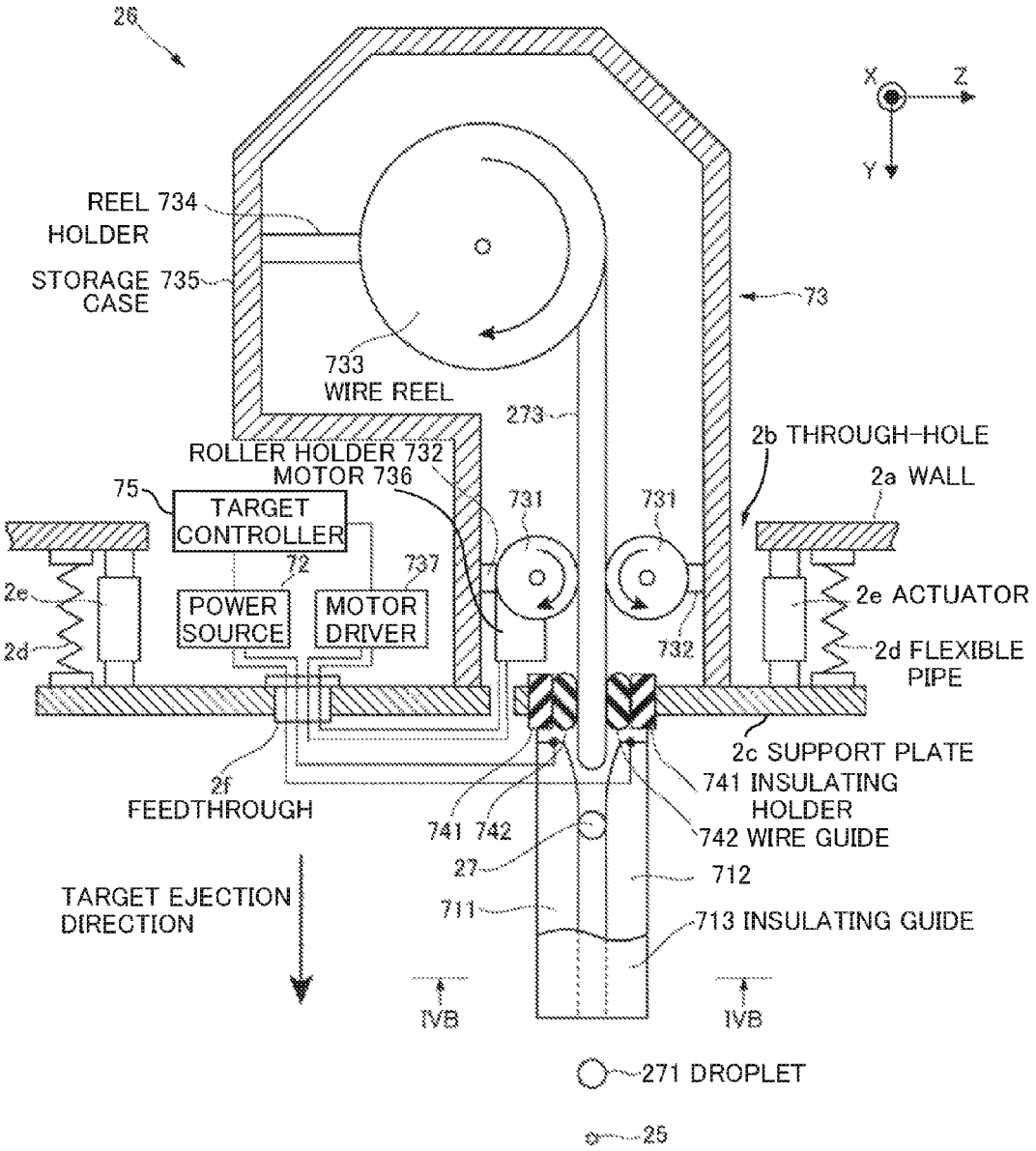
FIG. 4A is a drawing explaining the detailed configuration of the target supply apparatus.
Figure 4B:
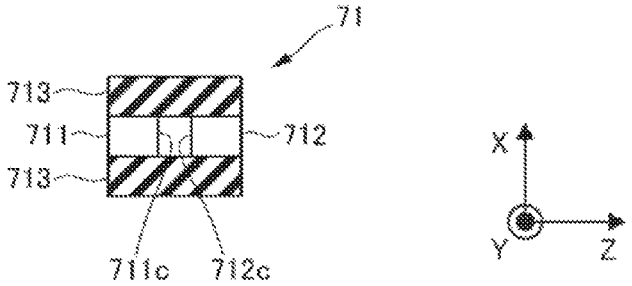
FIG. 4B is a cross-sectional view showing an electrode unit taken along line IVB-IVB shown in FIG. 4A.

With reference to FIGS. 4A and 4B, the detailed configuration of the target supply apparatus 26 will be described. FIG. 4A is a drawing explaining the detailed configuration of the target supply apparatus 26. FIG. 4B is a cross-sectional view showing the electrode unit 71 taken along line IVB-IVB shown in FIG. 4A. The configuration of the target supply apparatus 26 shown in FIGS. 4A and 4B, which is the same as that of the target supply apparatus 26 shown in FIGS. 1 to 3C, will not be described again here.

The target supply apparatus 26 may supply the target 27 into the chamber 2 via a through-hole 2*b* formed in a wall 2*a* of the chamber 2. With respect to the wall 2*a* of the chamber 2, the through-hole 2*b*, a support plate 2*c*, flexible pipes 2*d*, actuators 2*e*, and a feedthrough 2*f* may be provided.

The through-hole 2*b* may be provided in the wall 2*a* of the chamber 2 at a position in which the window 21 and the connection part 29 are not provided. The through-hole 2*b* may have a size that allows the target supply apparatus 26 to be inserted in the through-hole 2*b*. The support plate 2*c* may be provided inside the chamber 2 in the position which is the same as the position of the through-hole 2*b* in the X-axis direction and the Z-axis direction. The support plate 2*c* may be formed in the size greater than that of the through-hole 2*b*. The target supply apparatus 26 may be supported on the outer surface of the support plate 2*c*.

The flexible pipe 2*d* may make a connection between the wall 2*a* near the periphery of the through-hole 2*b* and the support plate 2*c*. The flexible pipe 2*d* may seal the space between the wall 2*a* and the support plate 2*c*. The flexible pipe 2*d* may be formed with bellows that can bear the stress caused by the difference in the pressure between the inside and outside of the chamber 2. By this means, the flexible pipes 2*d* may isolate the inside of the chamber 2 from the outside air.

The actuators 2*e* may change the position and the posture of the support plate 2*c*. The actuators 2*e* may be disposed to make a connection between the support plate 2*c* and the wall 2*a* near the periphery of the through-hole 2*b*. The actuators 2*e* may be disposed closer to the center of the through-hole 2*b* than the flexible pipe 2*d* connecting the wall 2*a* to the support plate 2*c*. The actuators 2*e* may be driven according to a driving signal from an actuator driver 51 shown in FIG. 19. The actuator driver 51 may generate and output a driving signal to the actuators 2*e* according to the control of the EUV light generation controller 5. This driving signal may be a control signal for changing the position and the posture of the support plate 2*c* to place the target supply apparatus 26 in a desired position and a desired posture. By this means, it is possible to adjust the position and the posture of the target supply apparatus 26 supported by the support plate 2*c* to a desired position and a desired posture, according to the control of the EUV light generation controller 5. Therefore, it is possible to adjust the traveling path of the target 27 supplied from the target supply apparatus 26, and also to adjust the arrival position of the target 27 in the plasma generation region 25.

The feedthrough 2*f* may pass signal lines that connect the pair of electrodes 710 to the power source 72 through the wall 2*a*. The feedthrough 2*f* may pass a signal line that connects the motor 736 to a motor driver 737 described later, through the wall 2*a*. Each of the signal lines passing through the inside of the feedthrough 2*f* may be electrically insulated from each other.

As described above, the target supply apparatus 26 may include the electrode unit 71, the power source 72, and the target transfer mechanism 73. The target supply apparatus 26 may further include insulating holders 741, wire guides 742, and a target controller 75.

The insulating holders 741 may be fixed to the periphery of the through-hole formed in the support plate 2*c*. The insulating holders 741 may support the electrode unit 71. The insulating holders 741 may support the electrode unit 71 such that the direction in which the target 27 is ejected from the electrodes 710 is toward the plasma generation region 25. The insulating holders 741 may be electrically and thermally insulative. The wire guides 742 may be fixed to at least part of the inner peripheries of the insulating holders 741.

The wire guides 742 may hold the target wire 273 transferred from the target transfer mechanism 73. The wire guides 742 may guide the held target wire 273 to between the pair of electrodes 710. The wire guides 742 may be electrically insulative.

The electrode unit 71 may include insulating guides 713, in addition to the above-described pair of electrodes 710. The insulating guides 713 may support the pair of electrodes 710. As shown in FIG. 4B, the insulating guides 713 may sandwich and support the pair of electrodes 710, covering the surfaces of the pair of electrodes 710 which connect to the contact surfaces 711*c* and 712*c*. The space surrounded by the insulating guides 713 and the pair of electrodes 710 may define a traveling path of the target 27. The insulating guides 713 may be fixed to the insulating holders 741. The insulating guides 713 may be electrically and thermally insulative. The insulating guides 713 may be made of, for example, alumina or aluminum nitride.

The power source 72 may be connected to the target controller 75. The power source 72 may apply a voltage to between the pair of electrodes 710, according to a control signal from the target controller 75. This control signal may be a signal for controlling the operation of the power source 72 to supply a desired amount of current to the target 27 sandwiched between the pair of electrodes 710 at a desired timing. By this means, it is possible to supply the desired amount of current to the target 27 sandwiched between the pair of electrodes 710 at the desired timing, according to the control of the target controller 75. The power source 72 may include a voltage sensor (not shown). The power source 72 may detect a voltage between the pair of electrodes 710 by using the voltage sensor. The power source 72 may output a detection signal indicative of the detected voltage to the target controller 75.

The target transfer mechanism 73 may include roller holders 732, a wire reel 733, a reel holder 734, a storage case 735, the motor 736, and the motor driver 737, in addition to the above-described rollers 731.

The storage case 735 may store the rollers 731, the roller holders 732, the wire reel 733, the reel holder 734, and the motor 736 therein. The periphery of the opening of the storage case 735 may be fixed to the support plate 2*c*.

The roller holders 732 may rotatably support the rollers 731. The roller holders 732 that support the rollers 731 may be fixed to the inner surface of the storage case 735. The roller holders 732 may electrically insulate the rollers 731 from the storage case 735.

The reel holder 734 may rotatably support the wire reel 733. The reel holder 734 that supports the wire reel 733 may be fixed to the inner surface of the storage case 735. The reel holder 734 may electrically insulate the wire reel 733 from the storage case 735.

The wire reel 733 may be replaceably attached to the reel holder 734. The target wire 273 may be wound around and held by the wire reel 733. The target wire 273 wound around the wire reel 733 may be pulled out of the wire reel 733, and then sandwiched between the pair of rollers 731. The target wire 273 sandwiched between the pair of rollers 731 may pass through between the wire guides 742 and be guided to between the pair of electrodes 710.

The motor 736 may rotate the pair of rollers 731. The motor 736 may be a stepping motor or a servomotor. The motor 736 may be connected to the motor driver 737 via the feedthrough 2*f*. The motor 736 may drive the rollers 731 according to a driving signal from the motor driver 737. The drive signal may be a control signal for controlling the drive of the motor 736 to rotate the pair of rollers 731 at a desired operation timing and a desired angular velocity.

The motor driver 737 may drive the motor 736. The motor driver 737 may be connected to the target controller 75. The motor driver 737 may generate and output a driving signal to the motor 736, according to the control signal from the target controller 75. This control signal may be a signal for controlling the processing in the motor driver 737 to transfer a desired amount of the target wire 273 to between the pair of electrodes 710 at a desired timing. The motor driver 737 may specify the operation timing and the angular velocity of the rollers 731 corresponding to the control signal from the target controller 75. The motor driver 737 may generate a driving signal indicative of the driving timing and the number of the rotation corresponding to the specified operation timing and angular velocity of the rollers 731, and output the signal to the motor 736. The pair of rollers 731 may rotate at the operation timing and the angular velocity corresponding to the driving signal from the motor driver 737. By this means, it is possible to transfer a desired amount of the target wire 273 sandwiched between the pair of rollers 731 to between the pair of electrodes 710 at a desired transfer timing, according to the control of the target controller 75.

The target controller 75 may send/receive various signals to/from the EUV light generation controller 5. The target controller 75 may totally control the operation of each of the components of the target supply apparatus 26, based on the various signals sent from the EUV light generation controller 5.

The target controller 75 may receive a detection signal indicative of the voltage outputted from the power source 72. This detection signal indicative of the voltage may be a signal related to the value of the voltage between the pair of electrodes 710. When the target wire 273 contacts the pair of electrodes 710, the pair of electrodes 710 may be short-circuited by the target wire 273. When the pair of electrodes 710 is short-circuited, the voltage between the pair of electrodes 710 may be changed. By this means, the target controller 75 may determine whether or not the target wire 273 transferred by the target transfer mechanism 73 is sandwiched between the pair of electrodes 710. The target controller 75 may control the amount of the current to be supplied and the timing at which the current is supplied, and the amount of the target wire 273 to be transferred and the timing at which the target wire 273 is transferred, based on the timing at which the target wire 273 is sandwiched between the pair of electrodes 710.

Meanwhile, when the target wire 273 sandwiched between the pair of electrodes 710 is molten, and then the molten target 27 is ejected from between the pair of electrodes 710, the pair of electrodes 710 may be released from the short-circuit state. When the pair of electrodes 710 is released from the short-circuit state, the voltage between the pair of electrodes 710 may be changed. By this means, the target controller 75 may determine whether or not the target 27 has been ejected from between the pair of electrodes 710. The target controller 75 may control the amount of the current to be supplied and the timing at which the current is supplied, and the amount of the target wire 273 to be transferred and the timing at which the target wire 273 is transferred, based on the timing at which the target 27 is ejected from between the pair of electrodes 710. Here, a hardware configuration of the target controller 75 will be described later with reference to FIG. 20.

4.4 Operation

The actuators 2*e* may change the position and the posture of the support plate 2*c*, according to the driving signal from the actuator driver 51. The position and the posture of the target supply apparatus 26 may be adjusted to a desired position and a desired posture.

The target controller 75 may output a voltage application signal, which is a control signal for applying a voltage to between the pair of electrodes 710, to the power source 72. The power source 72 may apply a voltage to between the pair of electrodes 710, according to the voltage application signal from the target controller 75.

The target controller 75 may output, to the motor driver 737, a wire transfer signal, which is a control signal for transferring a desired amount of the target wire 273 to between the pair of electrodes 710 at a desired timing. The motor driver 737 may generate and output a driving signal to the pair of rollers 731, according to the wire transfer signal from the target controller 75. The pair of rollers 731 may transfer the target wire 273 to between the pair of electrodes 710 by a predetermined amount, according to the driving signal from the motor driver 737.

The target controller 75 may specify the timing at which the target wire 273 is sandwiched between the pair of electrodes 710, based on the voltage detection signal from the power source 72. The target controller 75 may output a wire transfer stop signal, which is a control signal to stop transferring the target wire 273, to the motor driver 737. The motor driver 737 may generate and output a driving stop signal to the pair of rollers 731, according to the wire transfer stop signal from the target controller 75. The pair of rollers 731 may stop transferring the target wire 273, according to the driving stop signal from the motor driver 737.

When the target wire 273 is sandwiched between the pair of electrodes 710, a current path may be defined by the pair of electrodes 710, the front end 273*a* of the target wire 273, and the power source 72. When the current path is defined, a current flows to the front end 273*a* of the target wire 273. Then, as described above with reference to FIGS. 3A to 3C, the front end 273*a* of the target wire 273 may be resistively heated and molten, and then separated from the target wire 273. The separated front end 273*a* may be accelerated by the Lorentz force, and then ejected from between the pair of electrodes 710. In this case, the target controller 75 may control the amount of the current supplied from the power source 72, in order to control the velocity of the ejection of the front end 273*a* from between the pair of electrodes 710. The front end 273*a* ejected into the chamber 2 may form a free interface by its surface tension so that a droplet 271 may be formed. The droplet 271 may travel through the chamber 2 and reach the plasma generation region 25.

The target controller 75 may specify the timing at which the front end 273*a* as the molten target 27 is ejected from between the pair of electrodes 710, based on the voltage detection signal from the power source 72. Then, after waiting for a predetermined period of time, the target controller 75 may output the wire transfer signal to the motor driver 737 again. The driving signal corresponding to this wire transfer signal may be inputted to the pair of rollers 731, and therefore the target wire 273 may be transferred to between the pair of electrodes 710 again. Here, the above-described period of time for which the target controller 75 waits may be determined based on a targeted value of the repetition frequency given by the EUV light generation controller 5.

In this way, the target supply apparatus 26 can melt the target wire 273 as the solid target 27 and eject the molten target 27 from between the pair of electrodes 710, and therefore can supply the droplet 271 to the plasma generation region 25 in the chamber 2. The target supply apparatus 26 can heat and melt the volume of the target 27 needed every time the target 27 is ejected, and therefore it is possible to reduce the power consumption and costs, compared to a case where all the targets 27 to be used are heated and molten in advance in a tank or the like. In the target supply apparatus 26, only the electrode unit 71 is a component subjected to a high temperature equal to or higher than the melting point of the target 27, and therefore it is possible to reduce the costs for the other components. Therefore, the target supply apparatus 26 can output the target 27 having a high melting point in the form of the droplet 271, with a simple configuration.

Here, the state of the target 27 sandwiched between the pair of electrodes 710 may include the following three states: a first state in which the front end 273*a* of the target wire 273 sandwiched between the pair of electrodes 710 is a solid; a second state in which the front end 273*a* is molten; and a third state in which the molten front end 273*a* is separated from the remaining part of the target wire 273. In the description of the embodiments, the expression "the target 27 sandwiched between the pair of electrodes 710" will be used, unless it is necessary to distinguish among these states.

4.5 Problem

As described above, the target supply apparatus 26 may resistively heat and melt the solid target 27 sandwiched between the pair of electrodes 710. When a current is supplied to the solid target 27 sandwiched between the pair of electrodes 710, Joule heat is generated in a portion of the target 27 in contact with the contact surfaces 711*c* and 712*c* of the pair of electrodes 710, so that the target 27 may start melting at that portion. It is because the contact resistance between the contact surfaces 711*c* and 712*c* of the pair of electrodes 710 and the solid target 27 is greater than the electric resistance of the core of the target 27. The target 27 sandwiched between the pair of electrodes 710 may be pulled by the Lorentz force, although only the portion of the target 27 in contact with the contact surfaces 711*c* and 712*c* is completely molten. To be more specific, the following phenomena (A) to (C) may occur.

(A) If only the portion of the target 27 sandwiched between the pair of electrodes 710, which contacts the contact surfaces 711*c* and 712*c*, is completely molten, a large frictional force may be generated between the target 27 and the contact surfaces 711*c* and 712*c*. Therefore, the portion of the target 27 in contact with the pair of electrodes 710 may adhere to the contact surfaces 711*c* and 712*c*, and therefore the target 27 may stay between the pair of electrodes 710. This may prevent the target 27 from being ejected smoothly from between the pair of electrodes 710.

(B) If only the portion of the target 27 sandwiched between the pair of electrodes 710, which contacts the contact surfaces 711*c* and 712*c*, is completely molten, only that portion may be pulled by the Lorentz force. Then, this contact portion of the target 27 may be separated from the core and its vicinity of the target 27. Therefore, the contact portion of the target 27 may not form the droplet 271 having a desired volume, and may be jetted in a mist form from between the pair of electrodes 710. This may prevent a desired volume of the droplet 271 from being ejected from between the pair of electrodes 710.

(C) If only the portion of the target 27 sandwiched between the pair of electrodes 710, which contacts the contact surfaces 711*c* and 712*c*, is completely molten, the contact between the target 27 and the pair of electrodes 710 may be easy to be broken while the target 27 is accelerated. As a result, the target 27 is not supplied with a current, and therefore the Lorentz force may not be applied. This may prevent the target 27 from being ejected from between the pair of electrodes 710 at a desired velocity.

Therefore, there is a demand for a technology that can melt the target 27 sandwiched between the pair of electrodes 710 to the core, move the molten target 27 between the pair of electrodes 710, and eject the molten target 27 into the chamber 2.

5. Target Supply Apparatus According to Embodiment 1

Now, with reference to FIGS. 5A to 6C, the target supply apparatus 26 according to Embodiment 1 will be described. The configuration of the electrode unit 71 of the target supply apparatus 26 according to Embodiment 1 may be different from that of the electrode unit 71 of the target supply apparatus 26 shown in FIGS. 1 to 4B. The configuration of the target supply apparatus 26 according to Embodiment 1, which is the same as that of the target supply apparatus 26 shown in FIGS. 1 to 4B, will not be described again here. The target supply apparatus 26 according to Embodiment 1 may have means for solving a problem with at least the above-described phenomenon (A).

The problem with the above-described phenomenon (A) is that, if only the portion of the target 27 sandwiched between the pair of electrodes 710, which contacts the contact surfaces 711*c* and 712*c*, is completely molten, a large frictional force may be generated between the target 27 and the contact surfaces 711*c* and 712*c*. Possible causes for the generation of the large frictional force are mainly the following (A1) and (A2).

(A1) The target 27 has a high viscosity because only the portion of the target 27 sandwiched between the pair of electrodes 710, which contacts the contact surfaces 711*c* and 712*c*, is completely molten.

(A2) The contact surfaces 711*c* and 712*c* have high wettability, adsorptivity, and chemical reactivity with respect to the target 27.

The target supply apparatus 26 according to Embodiment 1 may include the electrode unit 71 which is a means for solving the problem with the cause (A1). The target supply apparatus 26 having the electrode unit 71 according to Embodiment 1, which is a means for solving the problem with the cause (A), will be described as the first example of the target supply apparatus 26. The target supply apparatus 26 according to Embodiment 1 may include the electrode unit 71 which is a means for solving the problem with the cause (A2). The target supply apparatus 26 including the electrode unit 71, which is a means for solving the problem with the cause (A2), will be described as the second example of the target supply apparatus 26.

5.1 First Example of the Target Supply Apparatus

Now, with reference to FIGS. 5A to 5C, the first example of the target supply apparatus 26 will be described. The first example of the target supply apparatus 26 may include the electrode unit 71 which is a means for solving the problem with the cause (A1).

The first example of the target supply apparatus 26 may reduce the viscosity of the target 27 by melting the target 27 sandwiched between the pair of electrodes 710 to the core. In order to melt the target 27 to the core, the temperature of the core of the target 27 needs to be higher than the melting point of the target 27. In the target supply apparatus 26 shown in FIGS. 1 to 4B, the Joule heat generated in the portion of the solid target 27 sandwiched between the pair of electrodes 710, which contacts the contact surfaces 711*c* and 712*c*, is not easy to be transferred to the core of the target 27. This may be because the temperature of the pair of electrodes 710 is lower than the temperature of the core of the solid target 27 sandwiched between the pair of electrodes 710.

A possible cause for which the temperature of the pair of electrodes 710 is lower than the temperature of the core of the solid target 27 sandwiched between the pair of electrodes 710 is as follows. As shown in FIG. 4B, surfaces of the pair of electrodes 710, other than the contact surfaces 711*c*, 712*c* and surfaces on which the insulating guides 713 are not provided, are not insulated from the heat, and therefore may form a heat radiation path to the outside. In addition, the pair of electrodes 710 is connected to members having a high thermal conductivity such as the cathode terminal and the anode terminal of the power source 72, and therefore these members may form a heat radiation path. The amount of the heat flowing out of the pair of electrodes 710 may be greater than the amount of the heat generated in and flowing into the pair of electrodes 710. This is because a heat flux may be generated in the pair of the electrodes 710, in a direction from the portion in contact with the target 27 to the heat radiation path.

Figure 5A:
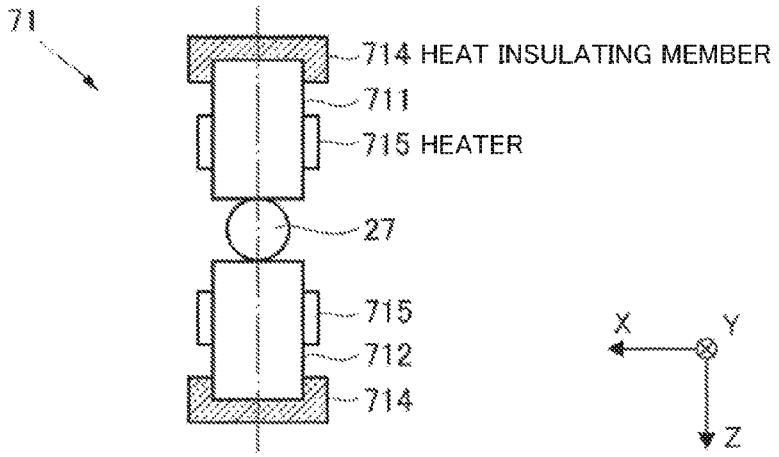
FIG. 5A is a drawing explaining a first example of the target supply apparatus.

FIG. 5A is a drawing explaining the first example of the target supply apparatus 26. The electrode unit 71 of the first example of the target supply apparatus 26 may include the pair of electrodes 710 and the insulating guides 713, as described above. The electrode unit 71 of the first example of the target supply apparatus 26 may further include heat insulating members 714 and heaters 715. Here, in FIG. 5A, the insulating guides 713 of the electrode unit 71 are not shown.

The heat insulating members 714 may block the heat radiation from the pair of electrodes 710 to the outside.

The heat insulating members 714 may be provided on the surfaces of the pair of the electrodes 710, which do not connect to the contact surfaces 711*c* and 712*c*. The heat insulating members 714 may be provided on the surfaces of the pair of electrodes 710, other than the contact surfaces 711*c* and 712*c* and surfaces on which the insulating guides 713 are not provided. The heat insulating members 714 may be electrically and thermally insulative.

The heaters 715 may heat the pair of electrodes 710. The heaters 715 may be placed on the surfaces of the pair of electrodes 710, which connect to the contact surfaces 711*c* and 712*c*. The heaters 715 may be placed on the surfaces of the pair of electrodes 710 where the insulating guides 713 are provided. The heaters 715 may be provided on the surfaces of the pair of electrodes 710 where the insulating guides 713 are provided, while being embedded in the insulating guides 713. The heaters 715 may be connected to the target controller 75, although not shown. The heaters 715 may heat the pair of electrodes 710 according to a control signal from the target controller 75. This control signal may be a signal for controlling the heating operation of the heaters 715 to keep the temperature of the pair of electrodes 710 higher than the melting point of the target 27. The control signal may be outputted from the target controller 75 to the heaters 715 before a voltage is applied to the pair of electrodes 710. By this means, according to the first example, the pair of electrodes 710 can be heated in advance by the heaters 715 before the power source 72 applies the voltage to the pair of electrodes 710, and therefore it is possible to keep the temperature of the pair of electrodes 710 higher than the melting point of the target 27.

When the pair of electrodes 710 is heated in advance by the heaters 715 to keep the temperature of the pair of electrodes 710 higher than the melting point of the target 27, the temperature of the pair of electrodes 710 may become higher than the temperature of the core of the target 27 sandwiched between the pair of electrodes 710. In this case, the Joule heat generated in the portion of the solid target 27 in contact with the contact surfaces 711*c* and 712*c* may be transferred to the core of the target 27. The solid target 27 sandwiched between the pair of electrodes 710 may be molten to the core by the transferred Joule heat. The viscosity of the target 27 molten to the core may be reduced. By this means, the first example of the target supply apparatus 26 can suppress a frictional force between the target 27 sandwiched between the pair of electrodes 710 and the contact surfaces 711*c* and 712*c*. Therefore, the first example of the target supply apparatus 26 can prevent the target 27 from adhering to the contact surfaces 711*c* and 712*c* and staying between the pair of electrodes 710. Therefore, the first example of the target supply apparatus 26 can smoothly eject the target 27 from between the pair of electrodes 710.

Figure 5B:
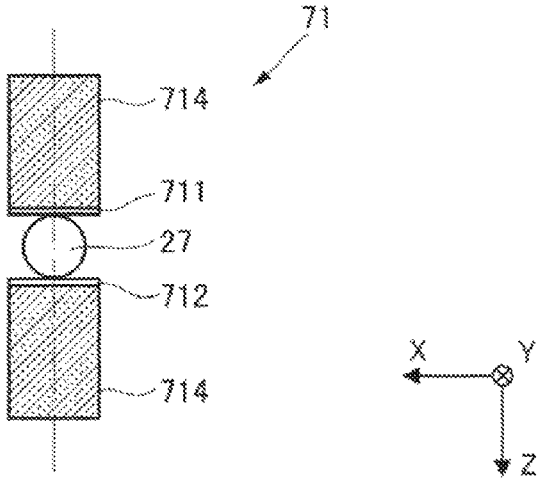
FIG. 5B is a drawing explaining Modification 1 of the first example of the target supply apparatus.

FIG. 5B is a drawing explaining Modification 1 of the first example of the target supply apparatus 26. A possible cause for which the temperature of the pair of electrodes 710 is lower than the temperature of the core of the solid target 27 sandwiched between the pair of electrodes 710 is as follows. When the volume of the pair of electrodes 710 is sufficiently greater than the volume of the solid target 27 sandwiched between the pair of electrodes 710, the heat capacity of the pair of electrodes 710 is greater than the solid target 27 sandwiched between the pair of electrodes 710. Therefore, the pair of electrodes 710 needs a longer period of time to reach the thermal saturation than the solid target 27, and therefore it is not easier to increase the temperature of the pair of electrodes 710 than the solid target 27.

According to Modification 1 of the first example, the electrode unit 71 may include the pair of electrodes 710, the insulating guides 713, and the heat insulating members 714. According to Modification 1 of the first example, the electrode unit 71 may not include the heaters 715. Here, the insulating guides 713 of the electrode unit 71 are not shown in FIG. 5B.

According to Modification 1 of the first example, as shown in FIG. 5B, the size and the positioning of the heat insulating members 714 may be the same as those of the pair of electrodes 710 according to the first example. According to Modification 1 of the first example, the surfaces of the pair of heat insulating members 714, which face one another, may be coated with an electrode material to form the pair of electrodes 710. According to Modification 1 of the first example, the surfaces of the pair of heat insulating members 714, which face one another, may be formed as films of an electrode material to form the pair of electrodes 710 by evaporation or thermal spraying. By this means, according to Modification 1 of the first example, it is possible to significantly reduce the size of the pair of electrodes 710. In addition, according to Modification 1 of the first example, the heat capacity of the pair of electrodes 710 may be smaller than the heat capacity of the solid target 27 sandwiched between the pair of electrodes 710.

Therefore, according to Modification 1 of the first example, the pair of electrodes 710 has a shorter period of time to reach the heat saturation than the target 27 sandwiched between the pair of electrodes 710, and therefore it can be easier to increase the temperature of the pair of electrodes 710 than the target 27. Then, according to Modification 1 of the first example, the pair of electrodes 710 is thermally insulated by the heat insulating members 714, and therefore is not easy to diffuse the heat. Consequently, it is possible to keep the temperature of the pair of electrodes 710 higher than the temperature of the core of the target 27. In this case, the Joule heat generated in the portion of the solid target 27 in contact with the pair of electrodes 710 may be transferred to the core of the target 27. The target 27 may be molten to the core by the transferred Joule heat. The viscosity of the target 27 molten to the core may be reduced. By this means, Modification 1 of the first example of the target supply apparatus 26 can suppress the frictional force between the pair of electrodes 710 and the target 27 sandwiched between the pair of electrodes 710. Consequently, Modification 1 of the first example of the target supply apparatus 26 can smoothly eject the target 27 from between the pair of electrodes 710.

Figure 5C:
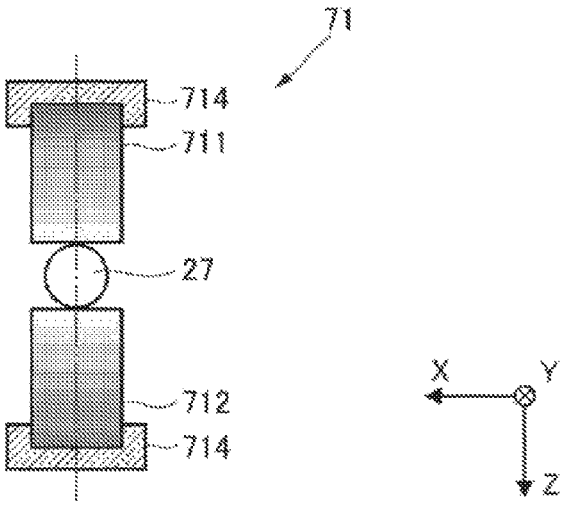
FIG. 5C is a drawing explaining Modification 2 of the first example of the target supply apparatus.

FIG. 5C is a drawing explaining Modification 2 of the first example of the target supply apparatus 26. A possible cause for which the temperature of the pair of electrodes 710 is lower than the temperature of the core of the solid target 27 sandwiched between the pair of electrodes 710 is as follows. The heat conductivity of the pair of electrodes 710 may tend to be higher than the heat conductivity of the solid target 27 sandwiched between the pair of electrodes 710. Consequently, the heat may be easier to be transferred to the inside of the pair of electrodes 710 than the inside of the target 27 by heat conduction.

According to Modification 2 of the first example, the electrode unit 71 may include the pair of electrodes 710, the insulating guides 713, and the heat insulating members 714. According to Modification 2 of the first example, the electrode unit 71 may not include the heaters 715. Here, the insulating guides 713 of the electrode unit 71 are not shown in FIG. 5C.

According to Modification 2 of the first example, the pair of electrodes 710 may be made of a material having a lower heat conductivity than the heat conductivity of the target 27. In this case, the Joule heat generated in the portion of the solid target 27 sandwiched between the pair of electrodes 710, which contacts the pair of electrodes 710, may be transferred to the core of the target 27. Therefore, the target 27 may be molten to the core by the transferred Joule heat. The viscosity of the target 27 molten to the core may be reduced. By this means, Modification 2 of the first example of the target supply apparatus 26 can suppress the frictional force between the pair of electrodes 710 and the target 27 sandwiched between the pair of electrodes 710. Consequently, Modification 2 of the first example of the target supply apparatus 26 can smoothly eject the target 27 from between the pair of electrodes 710.

5.2 Second Example of the Target Supply Apparatus

Now, with reference to FIGS. 6A to 6C, the second example of the target supply apparatus 26 will be described. The second example of the target supply apparatus 26 may include the electrode unit 71 which is a means for solving the problem with the cause (A2).

When the contact surfaces 711*c* and 712*c* of the pair of electrodes 710 has low wettability and adsorptivity with respect to the target 27, the following phenomena may occur. When the portion of the solid target 27 sandwiched between the pair of electrodes 710, which contacts the contact surfaces 711*c* and 712*c*, is molten, the molten portion may try to gather inside the target 27 by its surface tension while keeping the contact with the contact surfaces 711*c* and 712*c*. Then, the area of the molten portion of the target 27 in contact with the contact surfaces 711*c* and 712*c* is reduced, and therefore the heat generated in the contact portion may not be easy to be diffused to the pair of electrodes 710 but may be easy to be transferred to the core of the target 27. Then, before being pulled by the Lorentz force, not only the contact portion but also the core of the target 27 may be molten. The target 27 molten to the core may form the droplet 271 by its surface tension. The target 27 formed as the droplet 271 has a small area of the contact with the contact surfaces 711*c* and 712*c*, and therefore a frictional force generated between the target 27 and the contact surfaces 711*c* and 712*c* may be reduced. When the Lorentz force overcomes the frictional force, the target 27 formed as the droplet 271 may be ejected from between the pair of electrodes 710.

However, if the contact surfaces 711*c* and 712*c* have high wettability and adsorptivity with respect to the target 27, the following phenomena may occur. Even when the above-described contact portion of the solid target 27 sandwiched between the pair of electrodes 710 is molten, the surface tension may be offset by the interaction with the contact surfaces 711*c* and 712*c*. The contact portion whose surface tension is offset may not be easy to gather inside the target 27. Then, the area of the molten portion in contact with the contact surfaces 711*c* and 712*c* is not reduced, and therefore the heat generated in the contact portion may be easy to be diffused to the pair of electrodes 710 but not be easy to be transferred to the core of the target 27. Therefore, the target 27 sandwiched between the pair of electrodes 710 may not be easy to be molten to the core, and consequently not be easy to form the droplet 271. The target 27 which failed to form the droplet 271 has a large area of the contact with the contact surfaces 711*c* and 712*c*, and therefore the frictional force generated between the target 27 and the contact surfaces 711*c* and 712*c* may be increased. Consequently, the target 27 may not be easy to be smoothly ejected from between the pair of electrodes 710.

In addition, in a case where the chemical reactivity of the contact surfaces 711*c* and 712*c* with the target 27 is high, when the contact portion of the solid target 27 sandwiched between the pair of electrodes 710 is molten, the molten contact portion may be easy to chemically react with the contact surfaces 711*c* and 712*c*. Then, a solid reaction product may be generated on the contact surfaces 711*c* and 712*c*. The reaction product may adhere to the contact surfaces 711*c* and 712*c*, and generate a large frictional force between the target 27 and the contact surfaces 711*c* and 712*c*. Therefore, the target 27 may not be easy to be smoothly ejected from between the pair of electrodes 710.

Figure 6A:
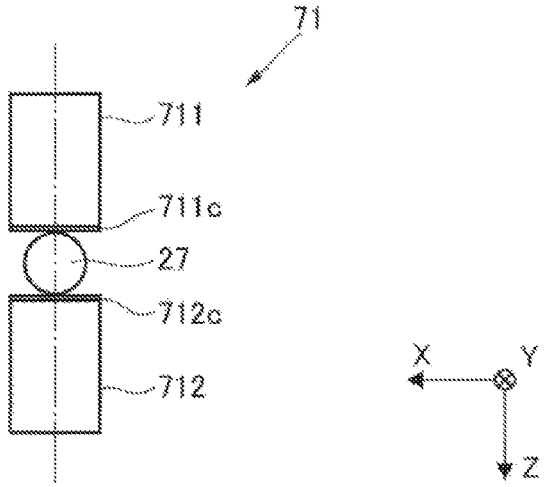
FIG. 6A is a drawing explaining a second example of the target supply apparatus.

FIG. 6A is a drawing explaining the second example of the target supply apparatus 26. The electrode unit 71 of the second example of the target supply apparatus 26 may include the pair of electrodes 710 having the contact surfaces 711*c* and 712*c* made of a material which is different from that of the target supply apparatus 26 shown in FIGS. 1 to 4B.

According to the second example, the contact surfaces 711*c* and 712*c* of the pair of electrodes 710 may be made of a material, which is not easy to chemically react with the target 27, has a low adsorptivity to the target 27, and has a contact angle equal to or smaller than 90 degrees with the molten target 27. In addition, the contact surfaces 711*c* and 712*c* may be made of a conductive material. According to the second example, the contact surfaces 711*c* and 712*c* of the pair of electrodes 710 may be formed by coating the contact surfaces 711*c* and 712*c* with the above-described material. The contact surfaces 711*c* and 712*c* may be formed by forming films on the contact surfaces 711*c* and 712*c* by evaporation or thermal spraying.

By this means, according to the second example, when the portion of the target 27 sandwiched between the pair of electrodes 710, which contacts the contact surfaces 711*c* and 712*c*, is molten, the surface tension of the target 27 is not offset due to the interaction with the contact surfaces 711*c* and 712*c*, so that it is possible to form the droplet 271. In addition, the target 27 may not be easy to generate any reaction product on the contact surfaces 711*c* and 712*c*. Accordingly, the second example of the target supply apparatus 26 can suppress a frictional force between the pair of electrodes 710 and the target 27 sandwiched between the pair of electrodes 710. As a result, the second example of the target supply apparatus 26 can smoothly eject the target 27 from between the pair of electrodes 710.

Figure 6B:
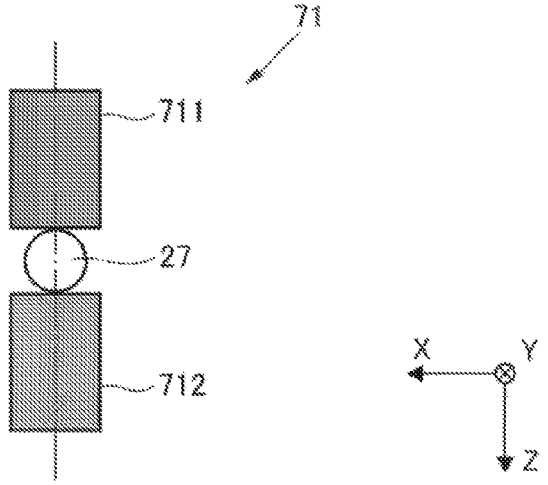
FIG. 6B is a drawing explaining Modification 1 of the second example of the target supply apparatus.

FIG. 6B is a drawing explaining Modification 1 of the second example of the target supply apparatus 26. According to Modification 1 of the second example, the pair of electrodes 710 of the electrode unit 71 may be made of a material, which is not easy to chemically react with the target 27, has a low adsorptivity to the target 27, and has a contact angle equal to or smaller than 90 degrees with the molten target 27. In addition, the pair of electrodes 710 may be made of a conductive material. By this means, Modification 1 of the second example of the target supply apparatus 26 can smoothly eject the target 27 from between the pair of electrodes 710, in the same way as the second example of the target supply apparatus 26 shown in FIG. 6A.

Figure 6C:
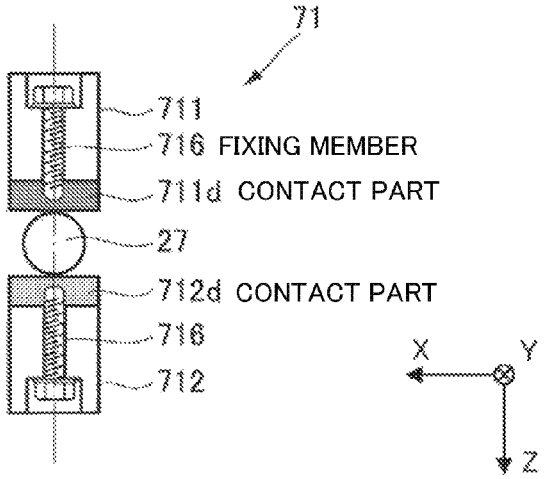
FIG. 6C is a drawing explaining Modification 2 of the second example of the target supply apparatus.

FIG. 6C is a drawing explaining Modification 2 of the second example of the target supply apparatus 26. According to Modification 2 of the second example, part of the pair of electrodes 710 of the electrode unit 71, which includes the contact surfaces 711*c* and 712*c*, may be formed as contact parts 711*d* and 712*d* which are separated from the pair of electrodes 710. The contact parts 711*d* and 712*d* may be made of a material which is not easy to chemically react with the target 27, has a low adsorptivity to the target 27, and has a contact angle equal to or smaller than 90 degrees with the target 27. In addition, the contact parts 711*d* and 712*d* may be made of a conductive material. The contact parts 711*d* and 712*d* may be fixed to the pair of electrodes 710 by using fixing members 716. By this means, Modification 2 of the second example of the target supply apparatus 26 can smoothly eject the target 27 from between the pair of electrodes 710, in the same way as the second example of the target supply apparatus 26 shown in FIG. 6A.

The other configuration of the target supply apparatus 26 according to Embodiment 1 may be the same as the configuration of the target supply apparatus 26 shown in FIGS. 1 to 4B.

6. Target Supply Apparatus According to Embodiment 2

Now, with reference to FIGS. 7 to 11B, the target supply apparatus 26 according to Embodiment 2 will be described. The target supply apparatus 26 according to Embodiment 2 may have a configuration where a magnetic field generation device 76 is added to the target supply apparatus 26 shown in FIGS. 1 to 4B. The configuration of the target supply apparatus 26 according to Embodiment 2, which is the same as that of the target supply apparatus 26 shown in FIGS. 1 to 4B, will not be described again here. Examples of the target supply apparatus 26 according to Embodiment 2 will be described as the third and fourth examples. The target supply apparatus 26 according to Embodiment 2 may have means for solving the problem with at least the above-described phenomenon (B).

The problem with the phenomenon (B) may be that if only the portion of the target 27 sandwiched between the pair of electrodes 710, which contacts the contact surfaces 711*c* and 712*c*, is completely molten, only this portion may be pulled by the Lorentz force, and therefore be separated from the core and its vicinity of the target 27. A possible cause for which only the portion of the target 27 in contact with the contact surfaces 711*c* and 712*c* is pulled by the Lorentz force is mainly as follows. When only the portion of the target 27 sandwiched between the pair of electrodes 710, which contacts the contact surfaces 711*c* and 712*c*, is molten, the surface tension of the molten target 27 cannot overcome the Lorentz force. In other words, before the target 27 sandwiched between the pair of electrodes 710 is molten to the core and has a sufficient surface tension, the Lorentz force strong enough to separate the molten part of the target 27 may be applied to the target 27.

6.1 Third Example of the Target Supply Apparatus

Figure 7:
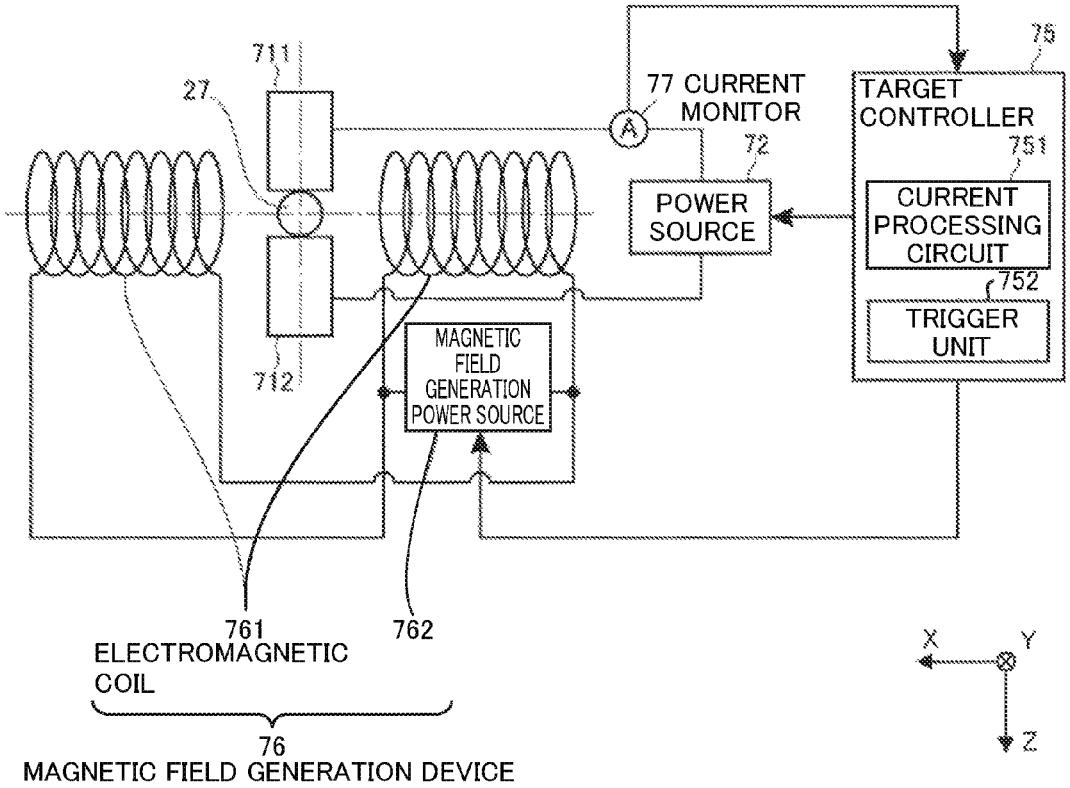
FIG. 7 is a drawing explaining a third example of the target supply apparatus.

Now, with reference to FIGS. 7 to 9B, the third example of the target supply apparatus 26 will be described. FIG. 7 is a drawing explaining the third example of the target supply apparatus 26. Here, the insulating guides 713 of the electrode unit 71 are not shown in FIG. 7.

The third example of the target supply apparatus 26 may include the magnetic field generation device 76 and further include a current monitor 77. The target controller 75 of the third example of the target supply apparatus 26 may include a current processing circuit 751 and a trigger unit 752.

The magnetic field generation device 76 may generate a magnetic field between the pair of electrodes 710. The magnetic field generated by the magnetic field generation device 76 may be different from the magnetic field generated by flowing a current through the target 27 sandwiched between the pair of electrodes 710. In the description of the present embodiments, the magnetic field generated around the current supplied to the target 27 sandwiched between the pair of electrodes 10 may be referred to as "self-magnetic field." Meanwhile, the magnetic field generated by the magnetic field generation device 76 may be referred to as "external magnetic field." The magnetic field generation device 76 may include electromagnetic coils 761 and a magnetic field generation power source 762.

The electromagnetic coils 761 may generate an external magnetic field depending on the current flowing through the coils. The electromagnetic coils 761 may include a plurality of coils. The plurality of electromagnetic coils 761 may be arranged to face one another via the insulating guides 713.

The magnetic field generation power source 762 may supply a current to the electromagnetic coils 761. The magnetic field generation power source 762 may supply a current to the electromagnetic coils 761 such that the direction in which the target 27 is ejected from between the pair of electrodes 710 matches the direction in which the Lorentz force is applied to the target 27.

The magnetic field generation power source 762 may be connected to the target controller 75. The magnetic field generation power source 762 may supply a current to the electromagnetic coils 761, according to a control signal from the target controller 75. This control signal may be a signal for controlling the operation of the magnetic field generation power source 762 to supply a desired amount of current to the electromagnetic coils 761 at a desired timing. In addition, the control signal may include a trigger signal described later, which is outputted by the target controller 75. In this case, upon receiving the trigger signal, the magnetic field generation power source 762 may supply the desired amount of current to the electromagnetic coils 61 for a predetermined period of time.

The electromagnetic coils 761 may be supplied with the desired amount of current at the desired timing, according to the control of the target controller 75. The electromagnetic coils 761 may generate the external magnetic field having an intensity at a timing corresponding to the desired amount and the desired timing for the supply of the current. By this means, it is possible to apply the external magnetic field having the desired intensity to the target 27 sandwiched between the pair of electrodes 710 at the desired timing, according to the control of the target controller 75.

The current monitor 77 may be connected to the pair of electrodes 710, the power source 72, and the target controller 75. The current monitor 77 may detect the current flowing between the pair of electrodes 710. The current monitor 77 may output a detection signal indicative of the detected current to the target controller 75.

The current processing circuit 751 of the target controller 75 may receive the detection signal indicative of the detected current outputted from the current monitor 77. The current processing circuit 751 may calculate a total period of time for which the target 27 sandwiched between the pair of electrodes 710 is provided with the current, based on the detection signal from the current monitor 77. The current processing circuit 751 may previously store a required supply time, which is a period of time required to supply the current to melt the solid target 27 sandwiched between the pair of electrodes 710 to the core. This required supply time may be a period of time from the timing at which the current is supplied to the target 27 to the timing at which the target 27 is completely molten. The current processing circuit 751 may compare between the total period of time for which the target 27 is supplied with the current and the required supply time, and determine whether or not the target 27 sandwiched between the pair of electrodes 710 has been molten to the core. When determining that the target 27 has been molten to the core, the current processing circuit 751 may output a melting completion signal indicative of the timing at which the target 27 is completely molten to the trigger unit 752.

Here, the current processing circuit 751 may calculate a total amount of electric charge supplied to the target 27 sandwiched between the pair of electrodes 710, based on the detection signal from the current monitor 77. In addition, the current processing circuit 751 may previously store a required electric charge, which is a required amount of electric charge to melt the solid target 27 sandwiched between the pair of electrodes 710 to the core. The current processing circuit 751 may compare between the total amount of electric charge supplied to the target 27 and the required electric charge, and determine whether or not the solid target 27 sandwiched between the pair of electrodes 710 has been molten to the core.

The trigger unit 752 of the target controller 75 may control the timing at which the magnetic field generation power source 762 supplies a current to the electromagnetic coils 761. The trigger unit 752 may receive the melting completion signal outputted from the current processing circuit 751. The trigger unit 752 may output a trigger signal to the magnetic field generation power source 762, based on the inputted melting completion signal. This trigger signal may be a signal for triggering the magnetic field generation power source 762 to supply a current to the electromagnetic coils 761.

Figure 8:
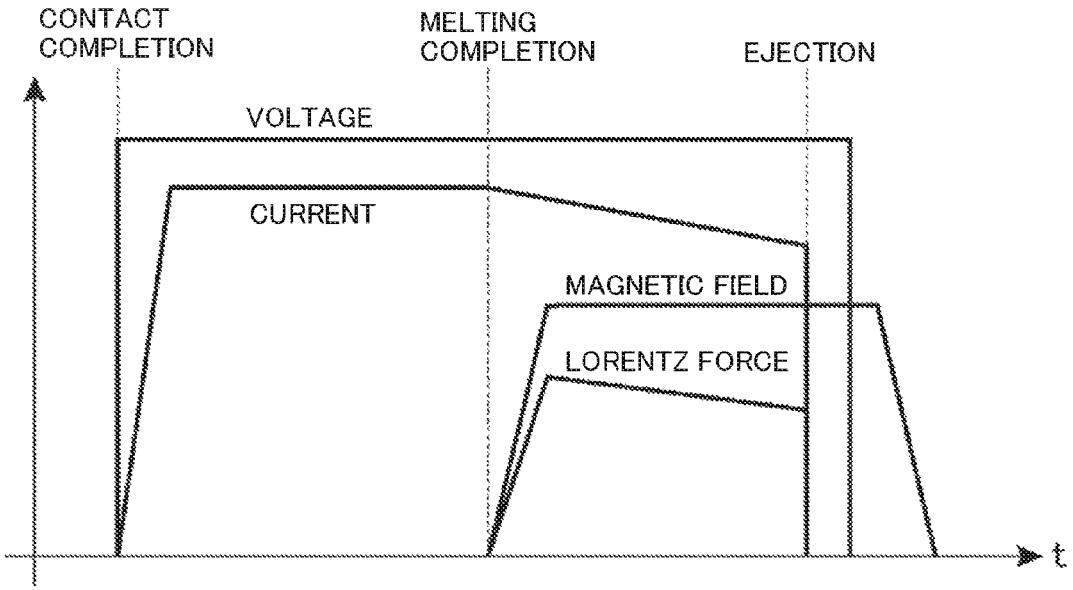
FIG. 8 is a drawing explaining timings at which a current, an external magnetic field, and a Lorentz force are applied to the target sandwiched between the pair of electrodes, respectively.

FIG. 8 is a drawing explaining the timings at which the current, the external magnetic field, and the Lorentz force are applied to the target 27 sandwiched between the pair of electrodes 710, respectively. In FIG. 8, the line "voltage" represents a change in the voltage applied between the pair of electrodes 710. The line "current" represents a change in the current flowing between the pair of electrodes 710. The line "magnetic field" represents a change in the external magnetic field generated between the pair of electrodes 710. The line "Lorentz force" represents a change in the Lorentz force induced by the current flowing between the pair of electrodes 710 and the external magnetic field.

The front end 273*a* of the target wire 273 may be transferred by the target transfer mechanism 73 and contact the contact surfaces 711*c* and 712*c* of the pair of electrodes 710. Having contacted the contact surfaces 711*c* and 712*c*, the front end 273*a* may be sandwiched between the pair of electrodes 710. The front end 273*a* sandwiched between the pair of electrodes 710 may be the solid target 27 sandwiched between the pair of electrodes 710. The target controller 75 may output a voltage application signal to the power source 72 at the timing at which the contact of the front end 273*a* with the contact surfaces 711*c* and 712*c* is completed, that is, the timing at which the solid target 27 is sandwiched between the pair of electrodes 710. The power source 72 may apply a voltage between the pair of electrodes 710. A current may flow through the solid target 27 sandwiched between the pair of electrodes 710. The melting of the target 27 may start at the portion in contact with the contact surfaces 711*c* and 712*c*.

When the current flows to the solid target 27 sandwiched between the pair of electrodes 710, the Lorentz force may be applied to the target 27 by the self-magnetic field. The target controller 75 may adjust the amount of the current supplied to the target 27 in order not to separate the portion of the target 27 in contact with the contact surfaces 711*c* and 712*c* from the core and its vicinity of the target 27 due to the Lorentz force induced by the self-magnetic field. Otherwise, the target controller 75 may stop supplying the current to the target 27. Since the magnetic field generation device 76 can generate the external magnetic field, the target controller 75 may reduce the amount of the current supplied to the target 27, which determines the intensity of the self-magnetic field, in order not to separate the contact portion of the target 27 from the core and its vicinity of the target 27 due to the Lorentz force induced by the self-magnetic field.

The target controller 75 may determine whether or not the target 27 sandwiched between the pair of electrodes 710 has been molten to the core, based on the detection signal from the current monitor 77. The target controller 75 may output the melting completion signal to the magnetic field generation device 76, at the timing at which the target 27 sandwiched between the pair of electrodes 710 is completely molten. Then, the magnetic field generation device 76 may generate the external magnetic field between the pair of electrodes 710. The external magnetic field may be applied to the target 27 sandwiched between the pair of electrodes 710, and the Lorentz force may be applied to the target 27. Between the pair of electrodes 710, the target 27 may move toward the direction in which the target 27 is ejected.

When the additional Lorentz force induced by the external magnetic field is applied to the target 27 moving between the pair of electrodes 710, the target 27 may be accelerated. When the target 27 is accelerated, the length of the current path defined by the pair of electrodes 710, the target 27, and the power source 72 may be increased, and therefore the electric resistance of the current path may be increased. In addition, the electric resistance of the molten target 27 may be higher than that of the solid target 27. Therefore, the amount of the current flowing to the accelerating target 27 may be reduced. Even when the magnetic field generation device 76 generates the external magnetic field having a constant intensity, the Lorentz force applied to the accelerating target 27 may be reduced. The accelerating target 27 may reach a desired velocity, and be ejected from between the pair of electrodes 710 into the chamber 2. The contact between the target 27 and the pair of electrodes 710 may be broken at the timing at which the target 27 is ejected from between the pair of electrodes 710. When the contact between the target 27 and the pair of electrodes 710 is broken, the current may not flow to the pair of electrodes 710 and the Lorentz force may also not be generated.

As described above, since the third example of the target supply apparatus 26 includes the magnetic field generation device 76, it is possible to reduce the Lorentz force induced by the self-magnetic field. Moreover, since the third example of the target supply apparatus 26 includes the magnetic field generation device 76, it is possible to generate the external magnetic field in synchronization with the timing at which the target 27 is molten to the core. That is, the third example of the target supply apparatus 26 can apply the external magnetic field to the target 27 in synchronization with the timing at which the target 27 is molten to the core. Moreover, the third example of the target supply apparatus 26 can apply the Lorentz force to the target 27, which is induced by the external magnetic field and is enough to accelerate the target 27, just after the target 27 is molten to the core. By this means, the third example of the target supply apparatus 26 can prevent the portion of the target 27 in contact with the contact surfaces 711*c* and 712*c* from separating from the core and its vicinity of the target 27. Therefore, the third example of the target supply apparatus 26 can prevent only the contact portion from being jetted in a mist form from between the pair of electrodes 710. Therefore, the third example of the target supply apparatus 26 can eject a desired volume of the droplet 271 from between the pair of electrodes 710.

Figure 9A:
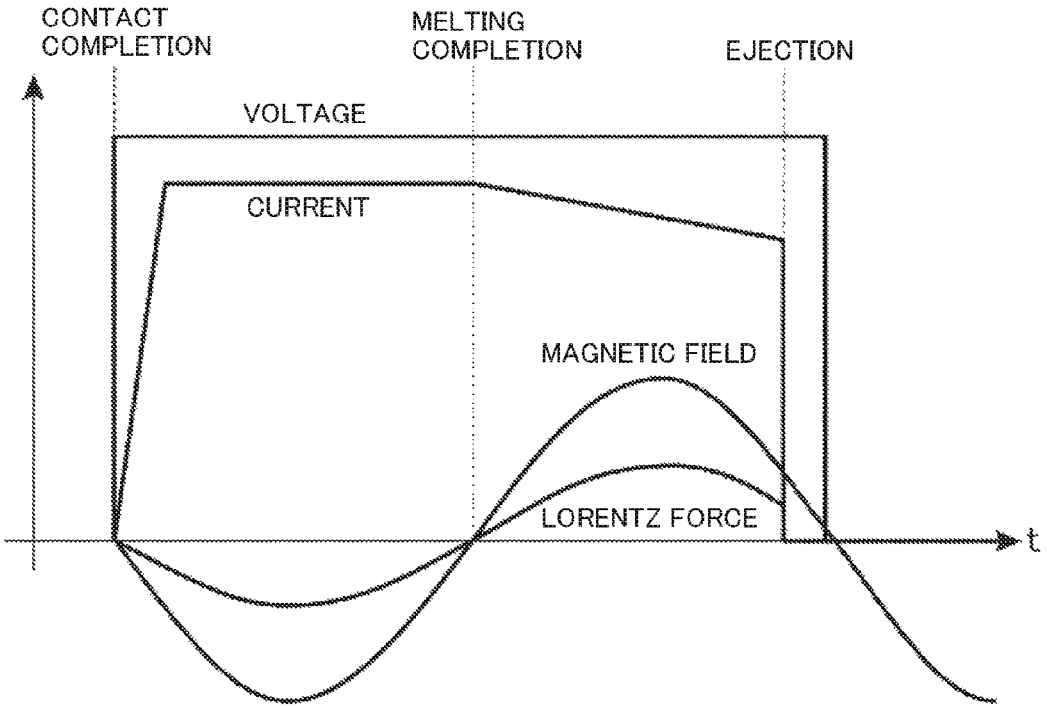
FIG. 9A is a drawing explaining Modification 1 of the third example of the target supply apparatus.

FIG. 9A is a drawing explaining Modification 1 of the third example of the target supply apparatus 26. According to Modification 1 of the third example of the target supply apparatus 26, the magnetic field generation device 76 may generate an AC magnetic field between the pair of electrodes 710. The target controller 75 may control the magnetic field generation device 76 such that the direction in which the target 27 sandwiched between the pair of electrodes 710 is moved by the Lorentz force induced by the AC magnetic field matches the direction in which the target 27 is ejected from between the pair of electrodes 710.

To be more specific, as described above, the target controller 75 may previously store the required supply time, which is a period of time from the timing at which the current is supplied to the solid target 27 sandwiched between the pair of electrodes 710 to the timing at which the target 27 is completely molten. The target controller 75 may control the magnetic field generation power source 762 to supply an AC current having the following cycle and phase to the electromagnetic coils 761. The half cycle of the AC current may be equivalent to the required supply time. The phase of the AC current may be defined such that the direction in which the target 27 is moved by the Lorentz force induced by the AC magnetic field matches the direction in which the target 27 is ejected, at the timing at which the target 27 is completely molten. The magnetic field generation power source 762 may supply the AC current having a waveform with the above-described cycle and phase to the electromagnetic coils 761, according to the control of the target controller 75. As the line "magnetic field" shown in FIG. 9A, the electromagnetic coils 761 may generate the AC magnetic field having a waveform corresponding to the AC current having the above-described cycle and phase, between the pair of electrodes 710. As the line "Lorentz force" shown in FIG. 9A, the Lorentz force having a waveform corresponding to the AC magnetic field may be applied to the target 27 sandwiched between the pair of electrodes 710.

As described above, even when the magnetic field generation device 76 configured to generate the AC magnetic field as an external magnetic field is provided, Modification 1 of the third example of the target supply apparatus 26 can apply the Lorentz force in the direction which is the same as the direction in which the target 27 is ejected, just after the target 27 is molten to the core. By this means, Modification 1 of the third example of the target supply apparatus 26 can also prevent only the portion of the target 27 in contact with the contact surfaces 711*c* and 712*c* from being jetted in a mist form from between the pair of electrodes 710. Therefore, Modification 1 of the third example of the target supply apparatus 26 can eject a desired volume of the droplet 271 from between the pair of electrodes 710, in the same way as the third example of the target supply apparatus 26 shown in FIGS. 7 and 8.

Figure 9B:
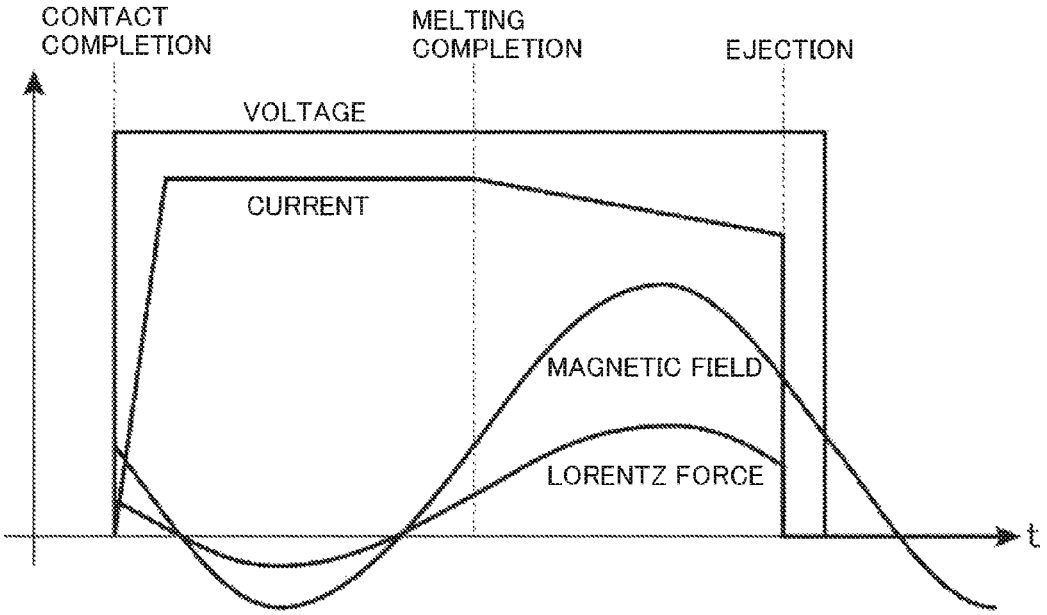
FIG. 9B is a drawing explaining Modification 2 of the third example of the target supply apparatus.

FIG. 9B is a drawing explaining Modification 2 of the third example of the target supply apparatus 26. According to Modification 2 of the third example of the target supply apparatus 26, the magnetic field generation power source 762 may supply an AC current with a bias current of a DC component to the electromagnetic coils 761. According to Modification 2 of the third example, the AC magnetic field generated by the electromagnetic coils 761 may be biased depending on the AC current supplied from the magnetic field generation power source 762, as the line "magnetic field" shown in FIG. 9B. As the line "Lorentz force" shown in FIG. 9B, the Lorentz force having a waveform corresponding to the AC magnetic field may be applied to the target 27 sandwiched between the pair of electrodes 710. Here, as the line "Lorentz force" shown in FIG. 9B, a case may be possible where the Lorentz force in the direction which is the same as the direction in which the target 27 is ejected is applied by the AC magnetic field by the biased AC current before the target 27 has not been completely molten. Even in this case, Modification 2 of the third example is applicable as long as the bias current value of the AC current can be limited to restrict the magnitude of the Lorentz force to prevent the portion of the target 27 in contact with the contact surfaces 711*c* and 712*c* from separating from the core and its vicinity of the target 27. By this means, Modification 2 of the third example of the target supply apparatus 26 can eject a desired volume of the droplet 271 from between the pair of electrodes 710, in the same way as the third example of the target supply apparatus 26 shown in FIGS. 7 and 8.

6.2 Fourth Example of the Target Supply Apparatus

Figure 10:
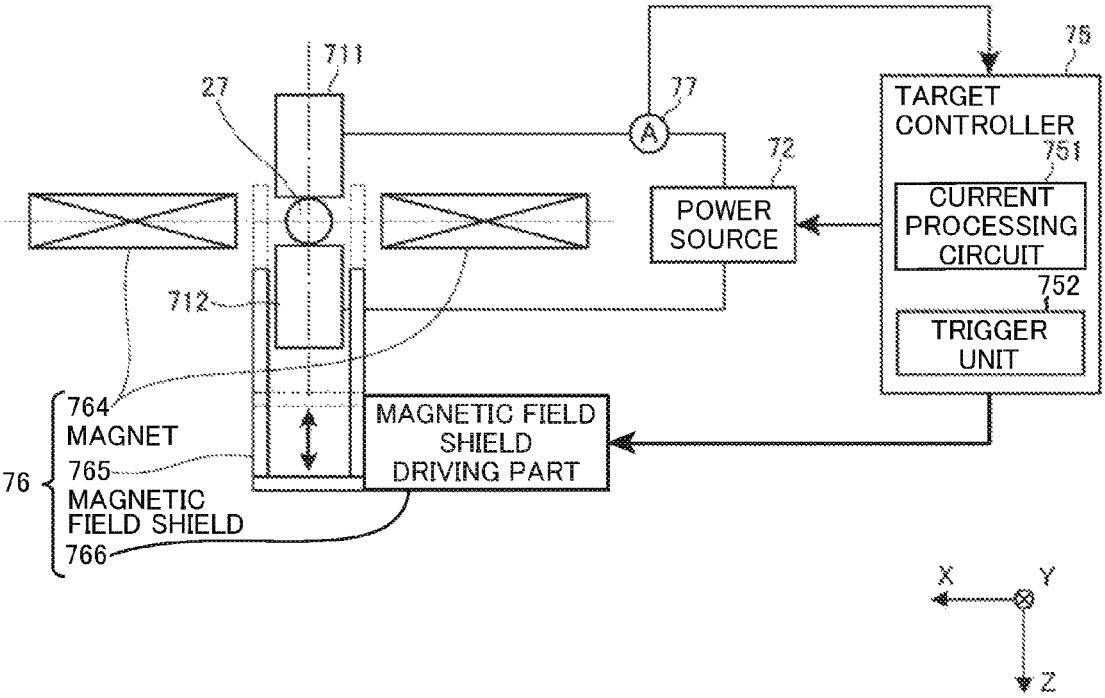
FIG. 10 is a drawing explaining a fourth example of the target supply apparatus.

Now, with reference to FIGS. 10 to 11B, the fourth example of the target supply apparatus 26 will be described. FIG. 10 is a drawing explaining the fourth example of the target supply apparatus 26. Here, the insulating guides 713 of the electrode unit 71 are not shown in FIG. 10.

The magnetic field generation device 76 of the fourth example of the target supply apparatus 26 may have a configuration different from that of the magnetic field generation device 76 of the third example of the target supply apparatus 26. The other configuration of the fourth example of the target supply apparatus 26 may be the same as the configuration of the third example of the target supply apparatus 26 shown in FIGS. 7 and 8. The magnetic field generation device 76 of the fourth example of the target supply apparatus 26 may include magnets 764, a magnetic field shield 765, and a magnetic field shield driving part 766.

The magnets 764 may generate a steady magnetic field as an external magnetic field. The magnets 764 may be a plurality of permanent magnets. The plurality of permanent magnets 764 may be arranged to face one another via the insulating guides 713. A gap with a predetermined distance may be provided each between the magnets 764 and the insulating guides 713. The magnets 764 may be electromagnets to which a steady current is supplied from the magnetic field generation power source (not shown), instead of the permanent magnets.

The magnetic field shield 765 may shield the pair of electrodes 710 from the steady magnetic field generated by the magnets 764. The magnetic field shield 765 may be formed with a mechanism having a plurality of shielding plates moving in parallel with each other at a time in one axial direction. The magnetic field shield 765 may be inserted into the gaps between the magnets 764 and the insulating guides 713. The magnetic field shield 765 may be removed from the gaps. The magnetic field shield 765 may be mechanically driven according to a driving signal from the magnetic field shield driving part 766.

The magnetic field shield driving part 766 may generate and output the driving signal to the magnetic field shield 765, according to the control of the target controller 75. This driving signal may be a control signal for inserting/removing the magnetic field shield 765 into/from the gaps between the magnets 764 and the insulating guides 713. To be more specific, the driving signal may be a control signal for removing the magnetic field shield 765 from the gaps in synchronization with the timing at which the target 27 is molten to the core. In addition, the driving signal may be a control signal for inserting the magnetic field shield 765 into the gaps in synchronization with the timing at which the target 27 is ejected from between the pair of electrodes 710. By this means, it is possible to apply the external magnetic field to the target 27 sandwiched between the pair of electrodes 710 in synchronization with the timing at which the target 27 is molten to the core, according to the control of the target controller 75. Therefore, the fourth example of the target supply apparatus 26 can eject a desired volume of the droplet 271 from between the pair of electrodes 710, in the same way as the third example of the target supply apparatus 26 shown in FIGS. 7 and 8.

Figure 11A:
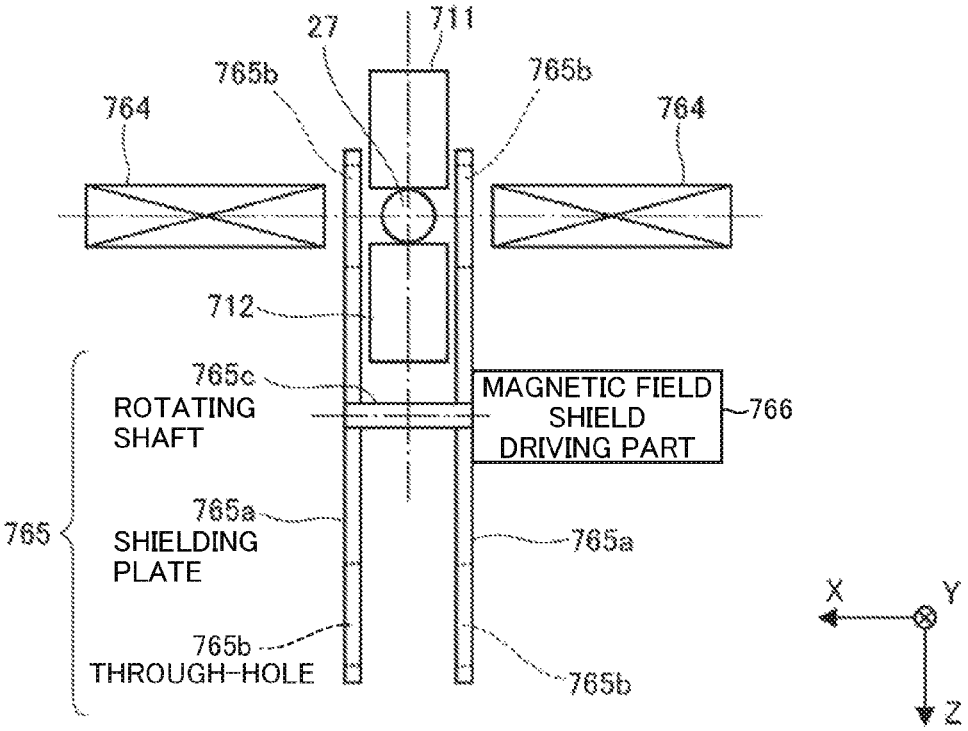
FIG. 11A is a drawing explaining a modification of the forth example of the target supply apparatus.
Figure 11B:
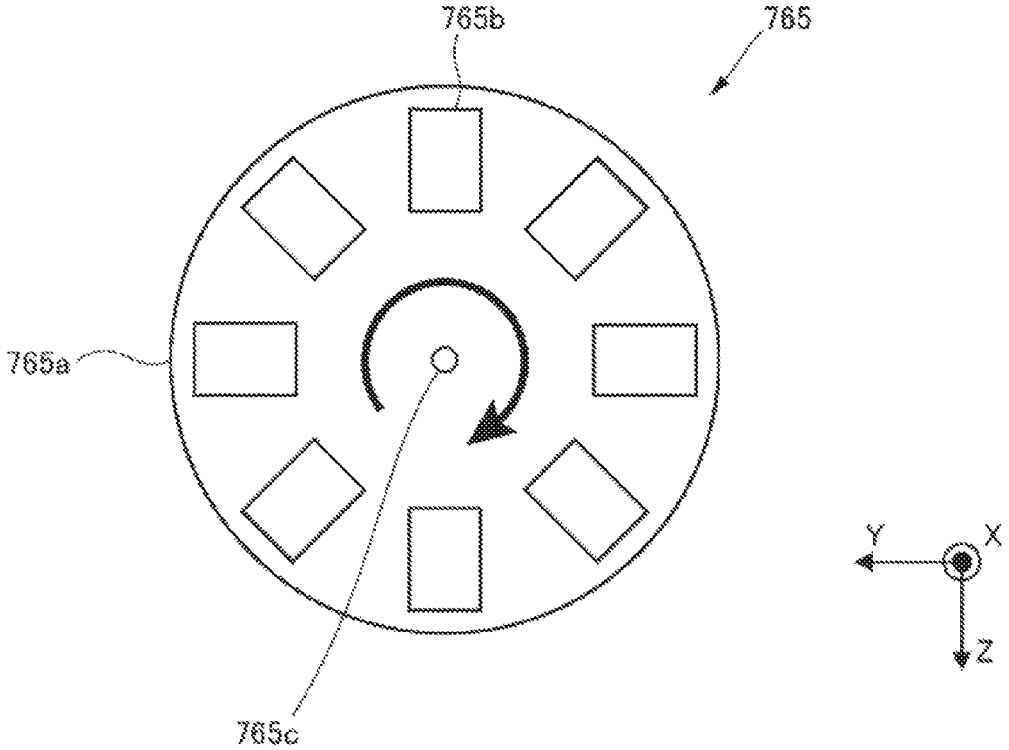
FIG. 11B is a drawing showing a magnetic field shield shown in FIG. 11A from an X-axis direction.

FIG. 11A is a drawing explaining a modification of the fourth example of the target supply apparatus 26. FIG. 11B is a drawing showing the magnetic field shield 765 shown in FIG. 11A from the X-axis direction. Here, the insulating guides 713 of the electrode unit 71 are not shown in FIG. 11A.

The magnetic field shield 765 of the modification of the fourth example of the target supply apparatus 26 may have a configuration different from that of the magnetic field shield 765 of the fourth example of the target supply apparatus 26. According to the modification of the fourth example, the magnetic field shield 765 may be formed with a mechanism having a plurality of shielding plates that rotate in the same direction at a time. The other configuration of the modification of the fourth example of the target supply apparatus 26 may be the same as the configuration of the fourth example of the target supply apparatus 26 shown in FIG. 10. The magnetic field shield 765 of the modification of the fourth example of the target supply apparatus 26 may include shielding plates 765*a*, through-holes 765*b*, and a rotating shaft 765*c*.

The shielding plates 765*a* may be a plurality of circular plates. A plurality of through-holes 765*b* may be provided in each of the plurality of circular shielding plates 765*a* along the circumferential direction of the circular plate. The plurality of through-holes 765*b* provided in one circular plate may be formed in the same size. The plurality of through-holes 765*b* provided in one circular plate may be arranged at even intervals in the one circular plate. The plurality of through-holes 765*b* provided in one circular plate may have the same distance from the rotating shaft 765*c* as the central axis. The relative positions of the plurality of through-holes 765*b* with respect to the rotating shaft 767*c* may be the same for each of the circular plates. The centers of the plurality of circular shielding plates 765*a* may be fixed to the same rotating shaft 765*c*. Each of the plurality of circular shielding plates 765*a* may be inserted into the gap between the magnet 764 and the insulating guide 713. In this case, the plurality of through-holes 765*b* provided in each of the plurality of circular plates may be inserted into the gap to face the magnet 764. The rotating shaft 765*c* may rotate according to a driving signal from the magnetic field shield driving part 766. The shielding plates 765*a* fixed to the rotating shaft 765*c* may be rotated by the rotation of the rotating shaft 765*c*.

The magnetic field shield driving part 766 may generate and output a driving signal to the magnetic field shield 765, according to the control of the target controller 75. This driving signal may be a control signal for rotating the rotating shaft 765*c*. To be more specific, the driving signal may be a control signal for rotating the rotating shaft 765*c* such that the through-holes 765*b* face the magnets 764 in synchronization with the timing at which the target 27 is molten to the core. In addition, the driving signal may be a control signal for rotating the rotating shaft 765*c* to prevent the through-holes 765*b* from facing the magnets 764 in synchronization with the timing at which the target 27 is ejected from between the pair of electrodes 710. By this means, it is possible to apply the external magnetic field to the target 27 sandwiched between the pair of electrodes 710 in synchronization with the timing at which the target 27 is molten to the core, according to the control of the target controller 75. Therefore, the modification of the fourth example of the target supply apparatus 26 can eject a desired volume of the droplet 271 from between the pair of electrodes 710, in the same way as the fourth example of the target supply apparatus 26 shown in FIG. 10.

The other configuration of the target supply apparatus 26 according to Embodiment 2 may be the same as the configuration of the target supply apparatus 26 shown in FIGS. 1 to 4B.

7. Target Supply Apparatus According to Embodiment 3

Now, with reference to FIGS. 12A to 15, the target supply apparatus 26 according to Embodiment 3 will be described. The target supply apparatus 26 according to Embodiment 3 may have a configuration where a pushing mechanism 78 is added to the target supply apparatus 26 shown in FIGS. 1 to 4B. The configuration of the target supply apparatus 26 according to Embodiment 3, which is the same as that of the target supply apparatus 26 shown in FIGS. 1 to 4B, will not be described again here. Examples of the target supply apparatus 26 according to Embodiment 3 will be described as the fifth to eighth examples. The target supply apparatus 26 according to Embodiment 3 may have a means for solving the problem with at least the above-described phenomenon (C).

The problem with the phenomenon (C) may be that if only the portion of the target 27 sandwiched between the pair of electrodes 710, which contacts the contact surfaces 711*c* and 712*c*, is completely molten, the contact between the accelerating target 27 and the pair of electrodes 710 may be easy to be broken. A possible cause for which the contact between the accelerating target 27 and the pair of electrodes 710 is easy to be broken is mainly as follows. When only the portion of the target 27 sandwiched between the pair of electrodes 710, which contacts the contact surfaces 711*c* and 712*c*, is completely molten, the volume of the accelerating target 27 may be reduced due to the above-described phenomena (A) and (B). When the volume of the accelerating target 27 is reduced, a gap is created between the target 27 and the pair of electrodes 710, and therefore the contact between the target 27 and the pair of electrodes 710 may be broken.

7.1 Fifth Example of the Target Supply Apparatus

Figure 12A:
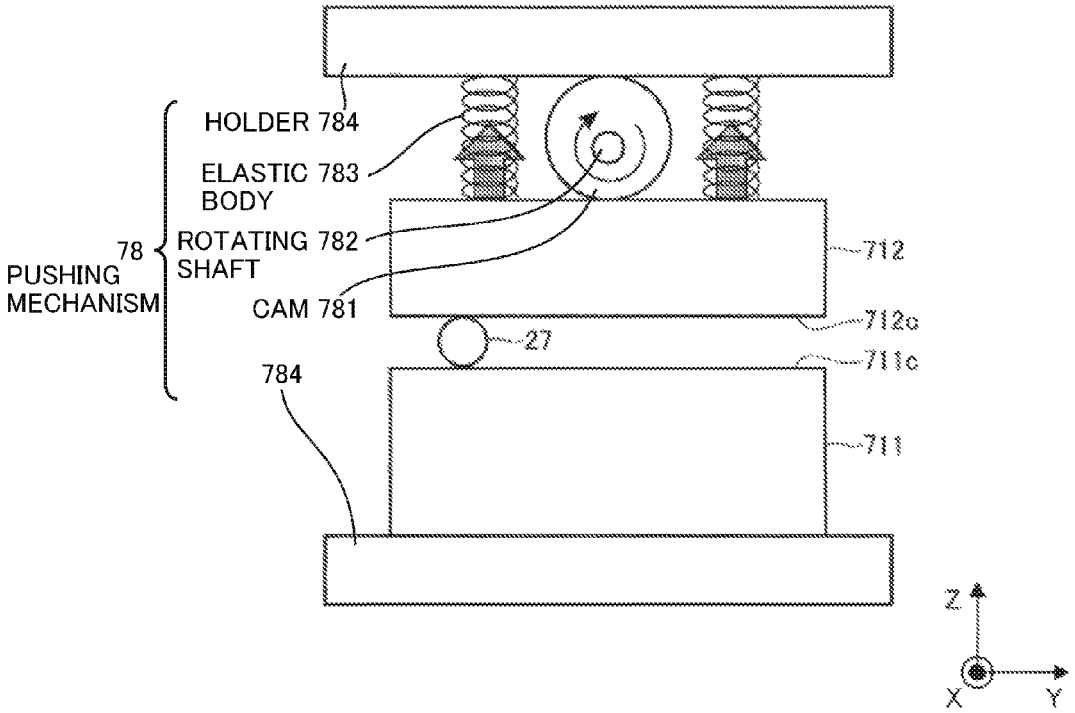
FIG. 12A is a drawing explaining a fifth example of the target supply apparatus.
Figure 12B:
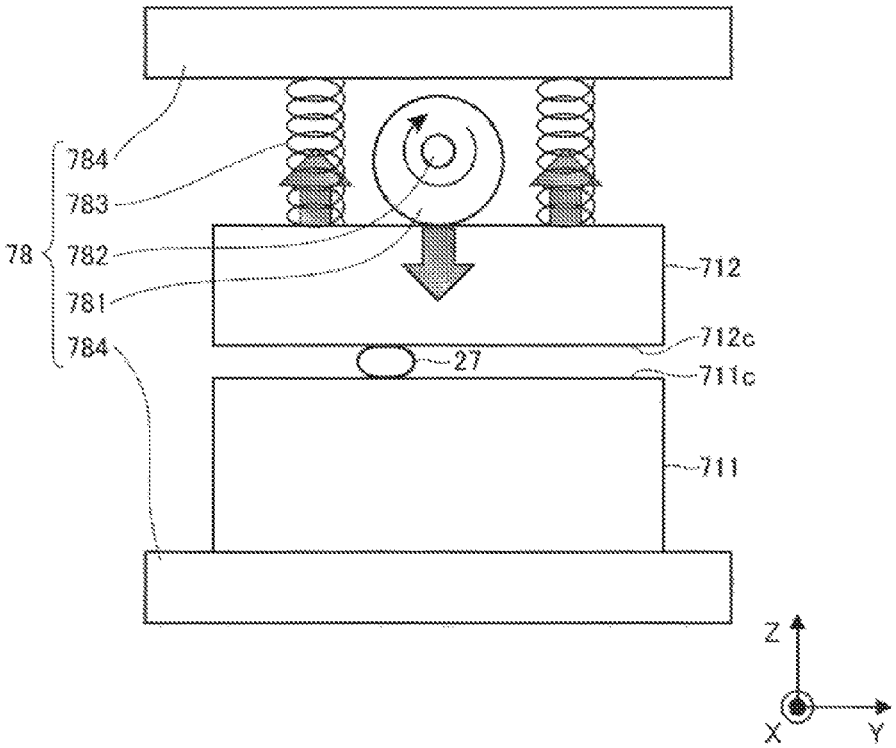
FIG. 12B is a drawing explaining the operation of a cam shown in FIG. 12A.

Now, with reference to FIGS. 12A and 12B, the fifth example of the target supply apparatus 26 will be described. FIG. 12A is a drawing explaining the fifth example of the target supply apparatus 26. FIG. 12B is a drawing explaining the operation of a cam 781 shown in FIG. 12A.

The pushing mechanism 78 of the fifth example of the target supply apparatus 26 may be a mechanism for pushing the contact surfaces 711*c* and 712*c* against the target 27 sandwiched between the pair of electrodes 710. According to the fifth example, the pushing mechanism 78 may be a mechanism for actively maintaining the contact between the pair of electrodes 710 and the target 27 sandwiched between the pair of electrodes 710. According to the fifth example, the pushing mechanism 78 may include the cam 781, a rotating shaft 782, elastic bodies 783, and holders 784.

The cam 781 may push the pair of electrodes 710 toward the direction in which the distance between the pair of electrodes 710 is reduced. The cam 781 may be an eccentric cam. At least the outer surface of the cam 781 may be made of a material being electrically insulative. The cam 781 may be disposed on the surface opposite to the contact surface 712*c* of the second electrode 712 of the pair of electrodes 710. The cam 781 may be attached to the rotating shaft 782 so as to be able to eccentrically rotate. The outer periphery of the cam 781 may contact the surface opposite to the contact surface 712*c* of the second electrode 712. The length of the outer periphery of the cam 781 may be longer than the distance from the position at which the front end 273*a* of the target wire 273 transferred by the target transfer mechanism 73 contacts the contact surfaces 711*c* and 712*c* to the first ends 711*a* and 712*a*. When the cam 781 is formed as a circular plate, the length of the outer periphery may be equal to or longer than a length which is twice as long as the distance from the position at which the front end 273*a* contacts the contact surfaces 711*c* and 712*c* to the first ends 711*a* and 712*a*.

The rotating shaft 782 may rotate the cam 781. The rotating shaft 782 may be provided at a position shifted from the center of the circular plate-shaped cam 781. The rotating shaft 782 may be connected to a driving device such as a motor (not shown). The driving device connected to the rotating shaft 782 may be driven according to the control of the target controller 75.

The driving device connected to the rotating shaft 782 may drive the rotating shaft 782 in synchronization with the timing at which the target 27 sandwiched between the pair of electrodes 710 is molten to the core. In addition, the driving device may drive the rotating shaft 782 in synchronization with the timing at which the target 27 sandwiched between the pair of electrodes 710 is ejected from between the pair of electrodes 710. The driving device connected to the rotating shaft 782 may drive the rotating shaft 782 such that the cam 781 pushes the pair of electrodes 710 toward the direction in which the distance between the pair of electrodes 710 is reduced at least during the period of time from the timing at which the target 27 is completely molten to the timing at which the target 27 is ejected. The driving device may drive the rotating shaft 782 such that the cam 781 pushes the pair of electrodes 710 toward the direction in which the distance between the pair of electrodes 710 is reduced during the period of time from the timing at which the target wire 273 is sandwiched between the pair of electrodes 710 to the timing at which the target 27 is ejected.

The elastic bodies 783 may support the second electrode 712 pushed by the cam 781. The elastic bodies 783 may connect the surface opposite to the contact surface 712*c* of the second electrode 712 to the holder 784. The elastic bodies 783 may be tension springs. The elastic bodies 783 may be, for example, coil springs or rubber. At least the outer surfaces of the elastic bodies 783 may be made of a material being electrically insulative. The elastic bodies 783 may pull the second electrode 712 in the direction in which the distance between the pair of electrodes 710 is increased. The elastic bodies 783 may be extended and shrunk by the rotation of the cam 781.

When the cam 781 pushes the pair of electrodes 710 in the direction in which the distance between the pair of electrodes 710 is reduced, the elastic bodies 783 may become longer than their natural length as shown in FIG. 12B. In this case, the elastic bodies 783 may become longer than their natural length to reduce the distance between the pair of electrodes 710 to the extent that the contact between the contact surfaces 711*c* and 712*c* and the target 27 can be maintained. By this means, the contact surfaces 711*c* and 712*c* of the pair of electrodes 710 can push the target 27 even when the target 27 sandwiched between the pair of electrodes 710 is molten and accelerating between the pair of electrodes 710. When the cam 781 does not push the pair of electrodes 710 toward the direction in which the distance between the pair of electrodes 710 is reduced, as shown in FIG. 12A, the elastic bodies 783 may become shorter than the length shown in FIG. 12B. In this case, the elastic bodies 783 may become shorter than the elastic bodies 783 shown in FIG. 12B such that the distance between the pair of electrodes 710 is increased to be similar to the diameter of the target wire 273. By this means, it is possible to return the contact surfaces 711*c* and 712*c* of the pair of electrodes 710 to positions that allow the target wire 723 to be smoothly transferred to between the pair of electrodes 710 after the target 27 sandwiched between the pair of electrode 710 is ejected from between the pair of electrodes 710.

The holder 784 may support the surface opposite to the contact surface 711*c* of the first electrode 711. The holder 784 may support the surface opposite to the contact surface 712*c* of the second electrode 712 via the elastic bodies 783. The holders 784 may be fixed to the insulating holders 741. The holders 784 may be electrically and thermally insulative.

Since the fifth example of the target supply apparatus 26 includes the pushing mechanism 78, it is possible to push the target 27 against the contact surfaces 711*c* and 712*c* of the pair of electrodes 710, even when the target 27 sandwiched between the pair of electrodes 710 is molten and accelerating. Therefore, the fifth example of the target supply apparatus 26 can prevent the gap from being created between the target 27 and the pair of electrodes 710, even when the volume of the accelerating target 27 is reduced. The fifth example of the target supply apparatus 26 can prevent the contact between the accelerating target 27 and the pair of electrodes 710 from being broken. By this means, the fifth example of the target supply apparatus 26 can supply the current to apply the Lorentz force to the accelerating target 27 until the target 27 is ejected from between the pair of electrodes 710. Therefore, the fifth example of the target supply apparatus 26 can eject the target 27 from between the pair of electrodes 710 at a desired velocity.

Here, although the configuration of the fifth example of the target supply apparatus 26 has been described where the cam 781, the rotating shaft 782, and the elastic bodies 783 are disposed on the second electrode 712 side, and only the second electrode 712 is moved, this is by no means limiting. Another configuration of the fifth example of the target supply apparatus 26 is possible where the cam 781, the rotating shaft 782, and the elastic bodies 783 are disposed on the first electrode 711 side, and only the first electrode 711 is moved. Moreover, further another configuration of the fifth example of the target supply apparatus 26 is possible where both the first electrode 711 and the second electrode 712 are moved.

7.2 Sixth Example of the Target Supply Apparatus

Figure 13A:
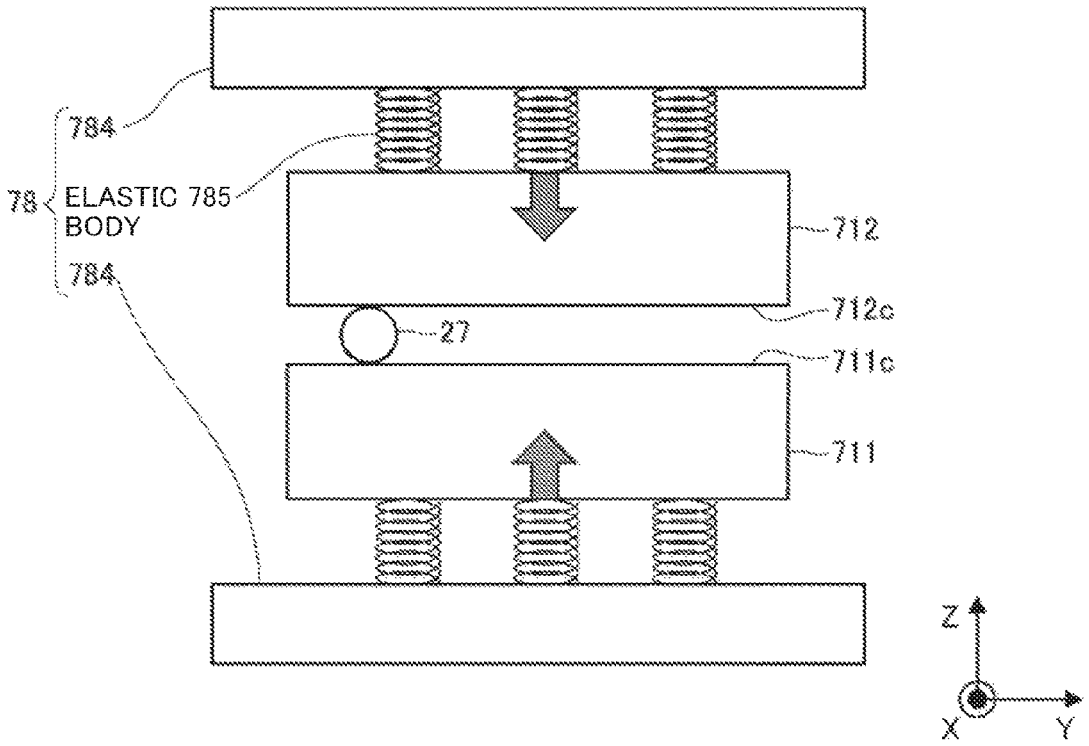
FIG. 13A is a drawing explaining a sixth example of the target supply apparatus.

Now, with reference to FIGS. 13A and 13B, the sixth example of the target supply apparatus 26 will be described. FIG. 13A is a drawing explaining the sixth example of the target supply apparatus 26.

The configuration of the pushing mechanism 78 of the sixth example of the target supply apparatus 26 may be different from that of the pushing mechanism 78 of the fifth example of the target supply apparatus 26. The other configuration of the sixth example of the target supply apparatus 26 may be the same as the configuration of the fifth example of the target supply apparatus 26 shown in FIGS. 12A and 12B. According to the sixth example, the pushing mechanism 78 may be a mechanism for passively maintaining the contact between the pair of electrodes 710 and the target 27 sandwiched between the pair of electrodes 710. According to the sixth example, the pushing mechanism 78 may include the holders 784 and elastic bodies 785.

According to the sixth example, the holder 784 may support the surface opposite to the contact surface 711*c* of the first electrode 711 via the elastic bodies 785. The holder 784 may support the surface opposite to the contact surface 712*c* of the second electrode 712 via the elastic bodies 785. The holders 784 may be fixed to the insulating holders 741. The holders 784 may be electrically and thermally insulative.

The elastic bodies 785 may push the pair of electrodes 710 toward the direction in which the distance between the pair of electrodes 710 is reduced. The elastic bodies 785 may be compression springs. The elastic bodies 785 may be, for example, coil springs or leaf springs. At least the outer surfaces of the elastic bodies 785 may be made of a material which is electrically insulative. The elastic bodies 785 may be disposed on the surface opposite to the contact surface 711*c* of the first electrode 711 of the pair of electrodes 710. The elastic bodies 785 may be disposed on the surface opposite to the contact surface 712*c* of the second electrode 712 of the pair of electrodes 710. The elastic bodies 785 may connect between the pair of electrodes 710 and the holders 784. The elastic bodies 785 may be extended and shrunk by the target 27 sandwiched between the pair of electrodes 710.

When the target 27 is not sandwiched between the pair of electrodes 710, the distance between the pair of electrodes 710 may be shorter than the diameter of the target wire 273. In this case, even when the target 27 sandwiched between the pair of electrodes 710 is molten and accelerating between the pair of electrodes 710, the distance between the pair of electrodes 710 may be small enough to maintain the contact between the contact surfaces 711*c* and 712*c* and the target 27. When the target wire 273 is moved between the pair of electrodes 710, the elastic bodies 783 may become shorter than when the target wire 273 is not sandwiched between the pair of electrodes 710 such that the distance between the pair of electrodes 710 is increased to be similar to the diameter of the target wire 273. By this means, the contact surfaces 711*c* and 712*c* of the pair of electrodes 710 can push the target 27 even when the target 27 sandwiched between the pair of electrodes 710 is molten and accelerating between the pair of electrodes 710. Here, although not shown in FIG. 13A, the distance between the pair of electrodes 710 is increased at a position near the second ends 711*b* and 712*b* to which the target wire 273 is transferred, as compared to the distance between the first ends 711*a* and 712*a*, and also the distance between the central parts as shown in FIG. 2. The transferred target wire 273 may be smoothly inserted in between the contact surfaces 711*c* and 712*c* of the pair of electrodes 710.

As described above, the sixth example of the target supply apparatus 26 can push the target 27 against the contact surfaces 711*c* and 712*c* of the pair of electrodes 710 even when the target 27 sandwiched between the pair of electrodes 710 is molten and accelerating. It is therefore possible to maintain the contact between the accelerating target 27 and the pair of electrodes 710. By this means, the sixth example of the target supply apparatus 26 can supply the current to apply the Lorentz force to the accelerating target 27 until the target 27 is ejected from between the pair of electrodes 710. Therefore, the sixth example of the target supply apparatus 26 can eject the target 27 from between the pair of electrodes 710 at a desired velocity, in the same way as the fifth example of the target supply apparatus 26 shown in FIGS. 12A and 12B.

Figure 13B:
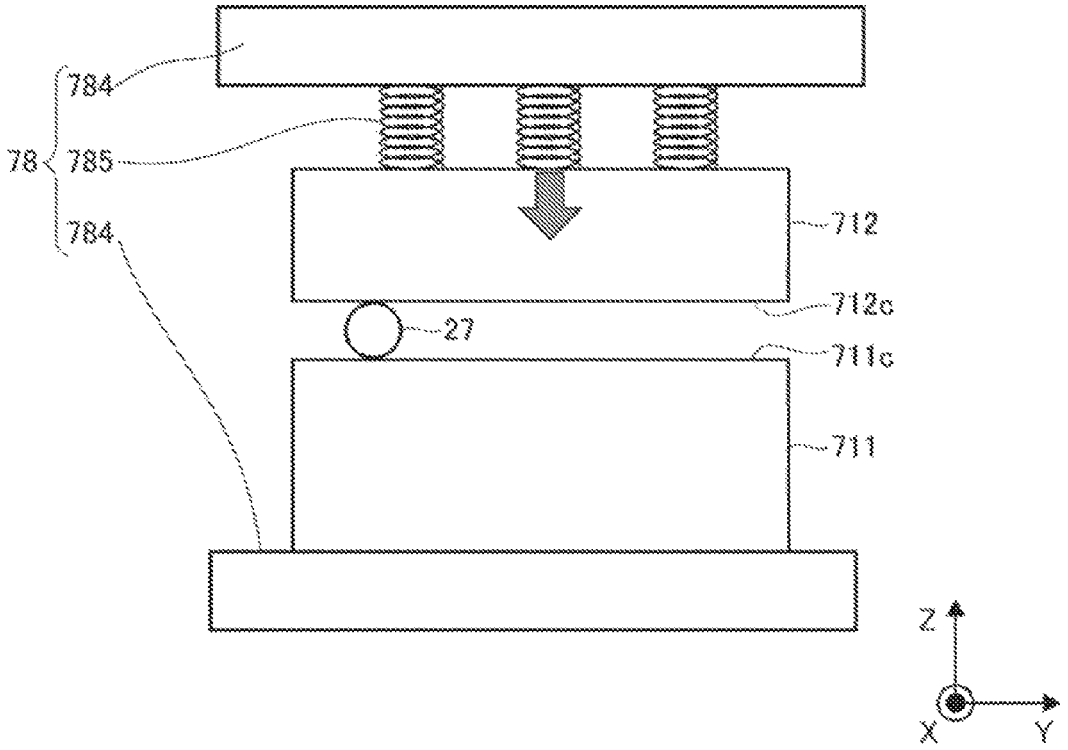
FIG. 13B is a drawing explaining a modification of the sixth example of the target supply apparatus.

FIG. 13B is a drawing explaining a modification of the sixth example of the target supply apparatus 26. Here, although the configuration of the sixth example of the target supply apparatus 26 has been described where the elastic bodies 785 are disposed on both the first electrode 711 and the second electrode 712, and both the first electrode 711 and the second electrode 712 are moved, this is by no means limiting. Another configuration of the sixth example of the target supply apparatus 26 is possible where the elastic bodies 785 are disposed on only the second electrode 712, and only the second electrode 712 is moved. Moreover, further another configuration of the sixth example of the target supply apparatus 26 is possible where the elastic bodies 785 are disposed on only the first electrode 711, and only the first electrode 711 is moved.

7.3 Seventh Example of the Target Supply Apparatus

Figure 14A:
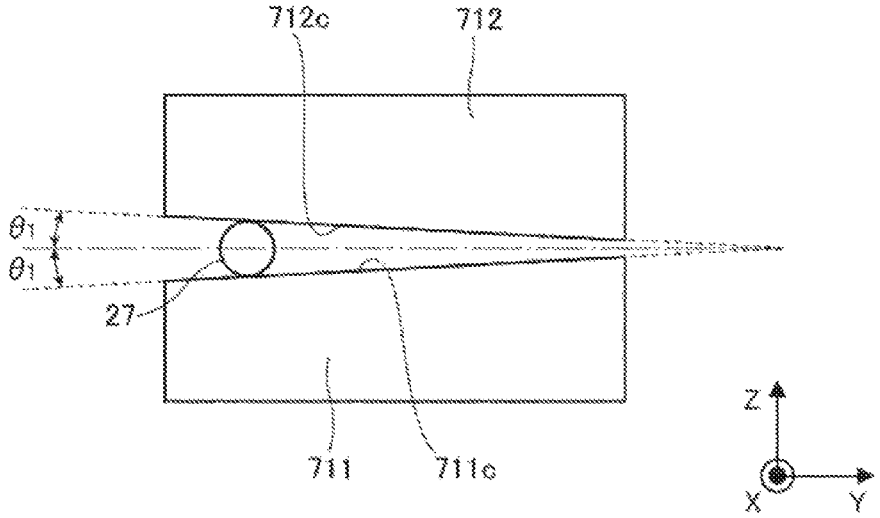
FIG. 14A is a drawing explaining a seventh example of the target supply apparatus.

Now, with reference to FIGS. 14A to 14C, the seventh example of the target supply apparatus 26 will be described. FIG. 14A is a drawing explaining the seventh example of the target supply apparatus 26.

The pushing mechanism 78 of the seventh example of the target supply apparatus 26 may have a configuration different from that of the pushing mechanism 78 of the fifth and sixth examples of the target supply apparatus 26. According to the seventh example, the pushing mechanism 78 may be a mechanism for passively maintaining the contact between the pair of electrodes 710 and the target 27 sandwiched between the pair of electrodes 710. According to the seventh example, the pushing mechanism 78 may be featured by positioning of the first electrode 711 and the second electrode 712 of the pair of electrodes 710

According to the seventh example, the first electrode 711 and the second electrode 712 may be disposed to be inclined to the direction in which the target 27 is ejected from between the pair of electrodes 710 at a predetermined angle $\theta_1$ so as to reduce the distance between the first electrode 711 and the second electrode 712. According to the seventh example, the distance between the pair of electrodes 710 may be reduced along the direction in which the target 27 is ejected from between the pair of electrodes 710.

The predetermined angle $\theta_1$ may be an angle that allows the distance between the pair of electrodes 710 near the second ends 711*b* and 712*b* to be greater than the diameter of the target wire 273. In addition, the predetermined angle $\theta_1$ may be an angle that allows the distance between the pair of electrodes 710 near the first ends 711*a* and 712*a* to be substantially the same as a desired diameter of the droplet 271 supplied into the chamber 2. Moreover, the predetermined angle $\theta_1$ may be an angle that allows the distance between the pair of electrodes 710, measured at positions from the position at which the transferred target wire 273 is sandwiched between the pair of electrodes 710 to the position near the first ends 711*a* and 712*a* to be equal to or shorter than the diameter of the molten target 27.

By this means, the contact surfaces 711*c* and 712*c* of the pair of electrodes 710 can push the target 27 sandwiched between the pair of electrodes 710 even when the target 27 is molten and accelerating between the pair of electrodes 710. Therefore, the seventh example of the target supply apparatus 26 can supply the current to apply the Lorentz force to the accelerating target 27 until the target 27 is ejected from between the pair of electrodes 710. Therefore, the seventh example of the target supply apparatus 26 can eject the target 27 from between the pair of electrodes 710 at a desired velocity, in the same way as the fifth example of the target supply apparatus 26 as shown in FIGS. 12A and 12B.

Figure 14B:
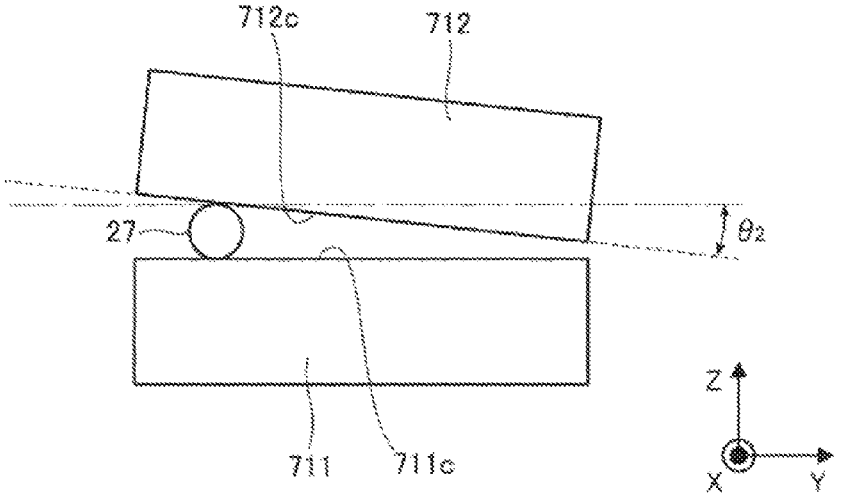
FIG. 14B is a drawing explaining Modification 1 of the seventh example of the target supply apparatus.
Figure 14C:
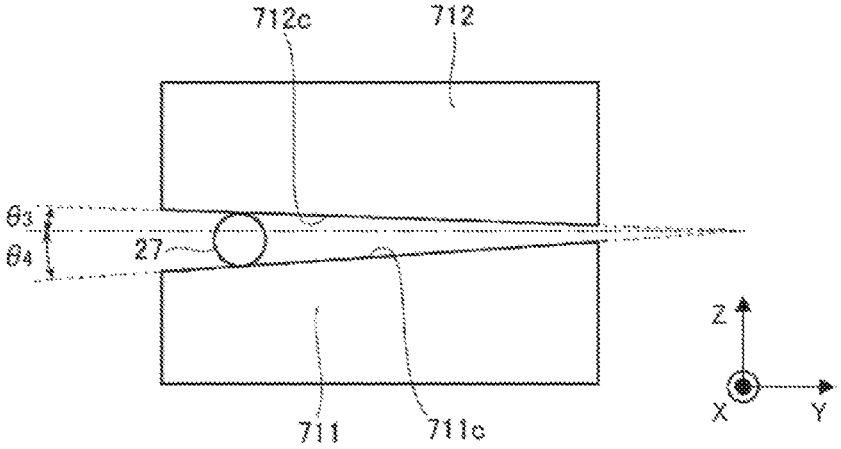
FIG. 14C is a drawing explaining Modification 2 of the seventh example of the target supply apparatus.

FIG. 14B is a drawing explaining Modification 1 of the seventh example of the target supply apparatus 26. FIG. 14C is a drawing explaining Modification 2 of the seventh example of the target supply apparatus 26. Although the configuration of the seventh example of the target supply apparatus 26 has been described where the first electrode 711 and the second electrode 712 are disposed to be inclined at the predetermined angle $\theta_1$, this is by no means limiting. Another configuration of the seventh example of the target supply apparatus 26 is possible where only the second electrode 712 is disposed to be inclined at a predetermined angle $\theta_2$ as shown in FIG. 14B. Meanwhile, in the seventh example of the target supply apparatus 26, only the first electrode 711 may be disposed to be inclined at the predetermined angle $\theta_2$. Further another configuration of the seventh example of the target supply apparatus 26 is possible where the first electrode 711 and the second electrode 712 are disposed to be inclined at predetermined different angles $\theta_3$ and $\theta_4$, respectively, as shown in FIG. 14C.

7.4 Eighth Example of the Target Supply Apparatus

Figure 15:
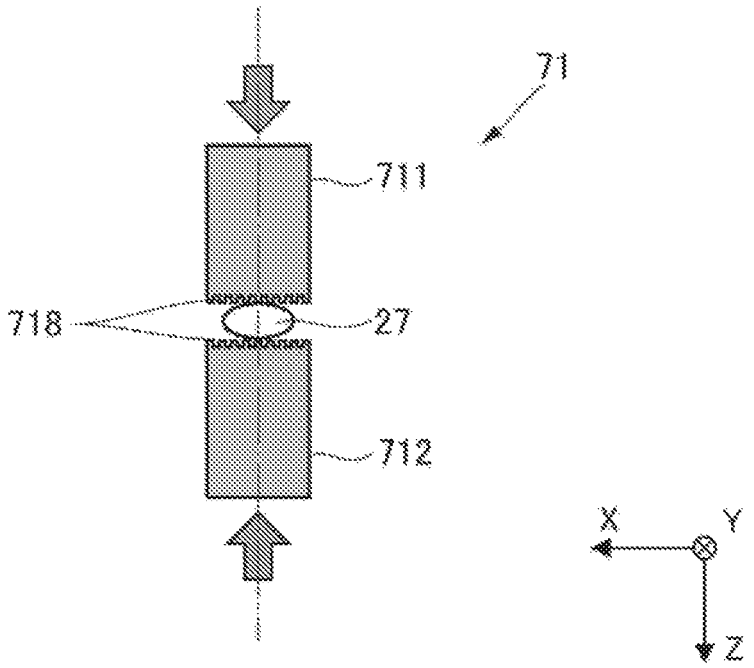
FIG. 15 is a drawing explaining an eighth example of the target supply apparatus.

Now, with reference to FIG. 15, the eighth example of the target supply apparatus 26 will be described. FIG. 15 is a drawing explaining the eighth example of the target supply apparatus 26. Here, the insulating guides 713 of the electrode unit 71 are not shown in FIG. 15.

The electrode unit 71 of the eighth example of the target supply apparatus 26 may have a configuration where grooves 718 are added to the electrode unit 71 according to the seventh example of the target supply apparatus 26 shown in FIG. 14A. Moreover, according to the eighth example, the pair of electrodes 710 of the electrode unit 71 may be made of a material which is the same as the material of the pair of electrodes 710 according to Modification 1 of the second example shown in FIG. 6B. According to the eighth example, the pushing mechanism 78 may be featured by positioning of the first electrode 711 and the second electrode 712 of the pair of electrodes 710, in the same way as the pushing mechanism 78 according to the seventh example.

According to the eighth example, the distance between the pair of electrodes 710 may be reduced along the direction in which the target 27 is ejected from between the pair of electrodes 710. The pair of electrodes 710 may be made of a material, which is not easy to chemically react with the target 27, has a low adsorptivity to the target 27, and has a contact angle equal to or smaller than 90 degrees with the molten target 27. In addition, the pair of electrodes 710 may be made of a conductive material. The grooves 718 may be formed in the contact surfaces 711*c* and 712*c* of the pair of electrodes 710. The grooves 718 may be formed to extend along the direction in which the target 27 is ejected.

By this means, according to the eighth example, it is possible to reduce the area of the contact between the target 27 sandwiched between the pair of electrodes 710 and the contact surfaces 711*c* and 712*c* of the pair of electrodes 710. If the area of the contact is reduced, when the solid target 27 sandwiched between the electrodes 710 is molten, the heat generated in the portion of the target 27 in contact with the contact surfaces 711*c* and 712*c* may not be easy to be diffused to the pair of electrodes 710. Therefore, the heat generated in the contact portion is easy to be transferred to the core of the target 27, and consequently the target 27 may be easy to be molten to the core. In addition, according to the eighth example, if the area of the contact is reduced, the frictional force generated between the target 27 accelerating between the pair of electrodes 710 and the contact surfaces 711*c* and 712*c* may be reduced. The accelerating target 27 may smoothly move between the pair of electrodes 710, and therefore be not easy to adhere to the electrodes 710, so that the volume of the target 27 may not be easy to be reduced. Therefore, the contact between the target 27 and the electrodes 710 may not be easy to be broken. By this means, the contact surfaces 711*c* and 712*c* of the pair of electrodes 710 can push the target 27 even when the target 27 sandwiched between the electrodes 710 is molten and accelerating between the electrodes 710. Therefore, the eighth example of the target supply apparatus 26 can supply the current to apply the Lorentz force to the accelerating target 27 until the target 27 is ejected from between the electrodes 710. Consequently, the eighth example of the target supply apparatus 26 can eject the target 27 from between the pair of electrodes 710 at a desired velocity, in the same way as the seventh example of the target supply apparatus 26 shown in FIGS. 14A to 14C.

The other configuration of the target supply apparatus 26 according to Embodiment 3 may be the same as the configuration of the target supply apparatus 26 shown in FIGS. 1 to 4B.

8. Target Supply Apparatus According to Embodiment 4

Figure 16A:
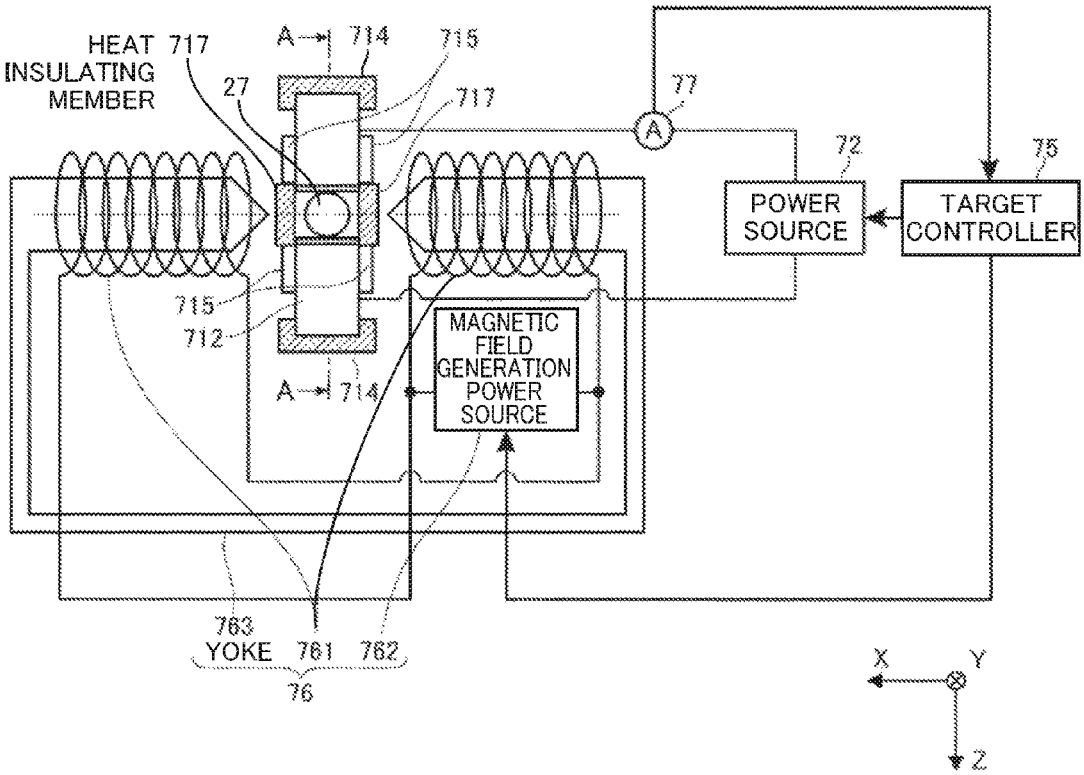
FIG. 16A is a drawing explaining a ninth example of the target supply apparatus.
Figure 16B:
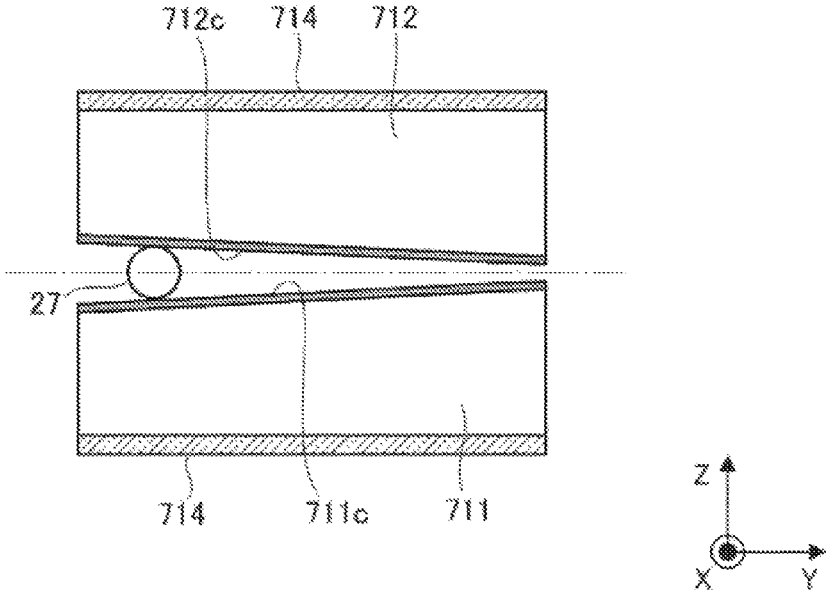
FIG. 16B is a cross-sectional view showing part of the electrode unit taken along line A-A shown in FIG. 16A.

Now, with reference to FIGS. 16A and 16B, the target supply apparatus 26 according to Embodiment 4 will be described. The target supply apparatus 26 according to Embodiment 4 may be configured with a combination of the configurations of the target supply apparatus 26 according to Embodiments 1 to 3 shown in FIGS. 1 to 15. The configuration of the target supply apparatus 26 according to Embodiment 4, which is the same as the configurations of the target supply apparatus 26 according to Embodiments 1 to 3 shown in FIGS. 1 to 15, will not be described again here. An example of the target supply apparatus 26 according to Embodiment 4 will be described as the ninth example.

8.1 Ninth Example of the Target Supply Apparatus

Now, with reference to FIGS. 16A and 16B, the ninth example of the target supply apparatus 26 will be described. FIG. 16A is a drawing explaining the ninth example of the target supply apparatus 26. FIG. 16B is a partial cross-sectional view showing the electrode unit 71 taken along line A-A shown in FIG. 16A. Here, the insulating guides 713 of the electrode unit 71 are not shown in FIGS. 16A and 16B.

The ninth example of the target supply apparatus 26 may be configured with a combination of the first example shown in FIG. 5A, the second example shown in FIG. 6A, the third example shown in FIG. 7, and the seventh example shown in FIG. 14A. In addition, the ninth example of the target supply apparatus 26 may have a configuration where a yoke 763 is added to the magnetic field generation device 76 according to the third example shown in FIG. 7. Moreover, the ninth example of the target supply apparatus 26 may have a configuration where heat insulating members 717 are added to the electrode unit 71 according to the first example shown in FIG. 5A.

According to the ninth example, the magnetic field generation device 76 may include the electromagnetic coils 761, the magnetic field generation power source 762, and the yoke 763.

The configurations of the electromagnetic coils 761 and the magnetic field generation power source 762 may be the same as those of the electromagnetic coils 761 and the magnetic field generation power source 762 according to the third example shown in FIG. 7.

The yoke 763 may be the core of the electromagnetic coils 761. The yoke 763 may be disposed in the electromagnetic coils 761. The yoke 763 may concentrate the magnetic lines of force of the external magnetic field generated by the electromagnetic coils 761 on between the pair of electrodes 710.

According to the ninth example, the electrode unit 71 may include the pair of electrodes 710, the insulating guides 713, the heat insulating members 714, the heaters 715, and the heat insulating members 717.

The configurations of the insulating guides 713, the heat insulating members 714, and the heaters 715 may be the same as those of the insulating guides 713, the heat insulating members 714, and the heaters 715 according to the first example shown in FIG. 5A.

The constituent material of the contact surfaces 711*c* and 712*c* of the pair of electrodes 710 may be the same as that of the contact surfaces 711*c* and 712*c* according to the second example shown in FIG. 6A. The positioning of the first electrode 711 and the second electrode 712 of the pair of electrodes 710 may be the same as that of the first electrode 711 and the second electrode 712 according to the seventh example shown in FIG. 14A. According to the ninth example, the pushing mechanism 78 may be featured by positioning of the first electrode 711 and the second electrode 712.

The heat insulating members 717 may block the heat release from the pair of electrodes 710 to the outside. The heat insulating members 717 may be provided on the surfaces of the pair of electrodes 710, which connect to the contact surfaces 711*c* and 712*c*. The heat insulating members 717 may be provided on the surfaces of the pair of electrodes 710 on which the insulating guides 713 may be provided. The heat insulating members 717 may be provided on the surfaces of the pair of electrodes 710 while being embedded in the insulating guides 713. The heat insulating members 717 may be provided to cover the space between the electrodes 710 along the direction in which the target 27 is ejected. The heat insulating members 717 may be electrically and thermally insulative.

According to the ninth example, the target controller 75 may perform the control which is the same as that of the target controller 75 according to the first example shown in FIG. 5A and the third example shown in FIG. 7.

With the above-described configuration, the ninth example of the target supply apparatus 26 can melt the target 27 sandwiched between the pair of electrodes 710 to the core, and suppress a frictional force between the target 27 and the pair of electrodes 710. In addition, the ninth example of the target supply apparatus 26 can generate an external magnetic field in synchronization with the timing at which the target 27 is molten to the core, and prevent only the portion of the target 27 in contact with the electrodes 710 from being jetted in a mist form from between the pair of electrodes 710. Moreover, the ninth example of the target supply apparatus 26 can push the accelerating target 27 against the electrodes 710 to maintain the contact between them, and supply the current to apply to the Lorentz force to the target 27 until the target 27 is ejected from between the pair of electrodes 710. Therefore, the ninth example of the target supply apparatus 26 can smoothly eject a desired volume of the droplet 271 from between the pair of electrodes 710 at a desired velocity.

The other configuration of the target supply apparatus 26 according to Embodiment 4 may be the same as the configuration of the target supply apparatus 26 shown in FIGS. 1 to 15. Here, the target supply apparatus 26 according to Embodiment 4 is not limited to the configuration with the combination of Embodiments 1 to 3 as the ninth example. The target supply apparatus 26 according to Embodiment 4 may have a configuration with a combination of Embodiment 1 to 3 in a different way from the ninth example.

9. Target Supply Apparatus According to Embodiment 5

Figure 17A:
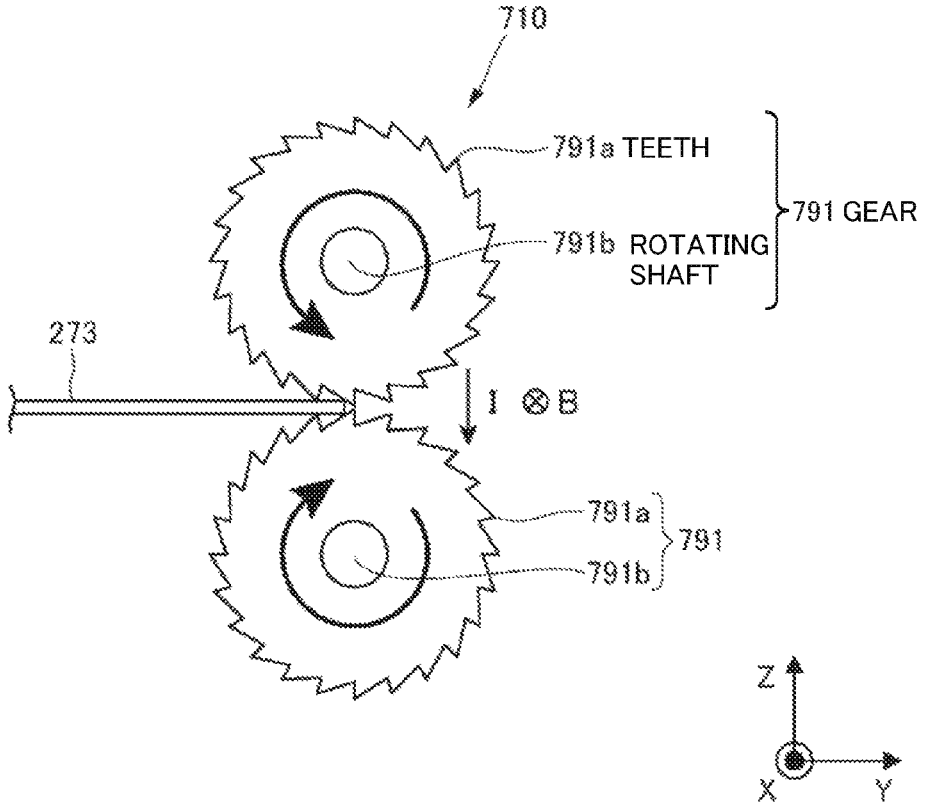
FIG. 17A is a drawing explaining a tenth example of the target supply apparatus.

Now, with reference to FIGS. 17A and 17B, the target supply apparatus 26 according to Embodiment 5 will be described. The configuration of the electrode unit 71 of the target supply apparatus 26 according to Embodiment 5 may be different from that of the electrode unit 71 of the target supply apparatus 26 according to Embodiments 1 to 4 shown in FIGS. 1 to 16B. The pair of electrodes 710 of the electrode unit 71 according to Embodiment 5 may not be formed as rails. The pair of electrodes 710 of the electrode unit 71 according to Embodiment 5 may rotate to eject the molten target 27 sandwiched between the pair of electrodes 710 from between the pair of electrodes 710. The configuration of the target supply apparatus 26 according to Embodiment 5, which is the same as the configuration of the target supply apparatus 26 shown in FIGS. 1 to 16B, will not be described again here. An example of the target supply apparatus 26 according to Embodiment 5 will be described as the tenth example.

9.1 Tenth Example of the Target Supply Apparatus

Now, with reference to FIG. 17A, the tenth example of the target supply apparatus 26 will be described. FIG. 17A is a drawing explaining the tenth example of the target supply apparatus 26.

The pair of electrodes 710 of the tenth example of the target supply apparatus 26 may be formed with a pair of gears 791. The pair of gears 791 may be connected to the power source 72. The magnetic field generation device 76 may generate an external magnetic field between the pair of gears 791. The target transfer mechanism 73 may transfer the target wire 273 to between the pair of gears 791. A current supplied from the power source 72 may flow through the target 27 sandwiched between the pair of gears 791.

Teeth 791*a* of each of the pair of gears 791 may be formed as a sawtooth wave. By this means, it is possible to reduce the area of the contact between the pair of gears 791 and the target 27 sandwiched between the pair of gears 791. Each of the pair of gears 791 may be rotatably attached to a rotation shaft 791*b*. The pair of gears 791 may be rotated in a direction to feed the target 27 toward the direction in which the target 27 is ejected. The rotation shaft 791*b* of each of the pair of gears 791 may be connected to a driving device such as a motor (not shown). The driving device connected to the rotation shaft 791*b* may be driven according to the control of the target controller 75.

The driving device connected to the rotation shaft 791*b* may drive the rotation shaft 791*b* in synchronization with the timing at which the target wire 273 as the solid target 27 is transferred to between the pair of gears 791. The teeth 791*a* of the pair of gears 791 may be sequentially guided to between the pair of gears 791 by the rotation of the pair of gears 791. The solid target 27 transferred to between the pair of gears 791 may be sandwiched between the pair of gears 791 while being pushed against the teeth 791*a* sequentially guided to between the pair of gears 791.

The driving device connected to the rotation shafts 791*b* may not drive the rotation shafts 791*b* during the period of time from the timing at which the solid target 27 is sandwiched between the pair of gears 791 to the timing at which the target 27 is completely molten. The area of the contact between the pair of gears 791 and the solid target 27 sandwiched between the pair of gears 791 is small, and therefore the heat generated in the portion of the target 27 in contact with the pair of gears 791 may not be easy to be diffused to the pair of gears 791. The target 27 may be molten to the core while being pushed against the teeth 791*a*.

The driving device connected to the rotation shafts 791*b* may drive the rotation shafts 791*b* in synchronization with the timing at which the target 27 sandwiched between the pair of gears 791 is molten to the core. When the pair of gears 791 is rotated, the teeth 791*a* located between the pair of gears 791 may be guided to reduce the distance between the pair of gears 791. The target 27 sandwiched between the pair of gears 791 may be pushed against the teeth 791*a* guided by the rotation of the pair of gears 791. The molten front end of the target 27 may be separated from the remaining unmolten part of the target 27 by the teeth 791*a* which have been guided to between the pair of gears 791 and have been pushing the target 27. The area of the contact between the target 27 and the gears 791 is small, and therefore the molten front end of the target 27 may not be easy to adhere to the gears 791 and to reduce its volume. As a result, it is possible to separate a constant volume of the target 27. The separated target 27 may form the droplet 271 and be smoothly ejected from between the pair of gears 791.

Moreover, during the period of time from the timing at which the target 27 is molten to the core to the timing at which the molten part of the target 27 is separated, the target 27 may be pushed against the teeth 791*a* without a reduction in the volume. A constant current may flow through the target 27. The magnetic field generation device 76 may generate an external magnetic field having a constant intensity in synchronization with the timing at which the target 27 sandwiched between the pair of gears 791 is molten to the core. By this means, it is possible to apply a constant Lorentz force to the molten front end of the target 27. After a constant volume of the target 27 is separated, the target 27 may be ejected at a constant velocity. In addition, it is possible to prevent only the portion of the target 27 in contact with the gears 791 from being jetted in a mist form.

As described above, the tenth example of the target supply apparatus 26 can melt the target 27 sandwiched between the pair of gears 791 to the core, and smoothly eject the molten target 27 as a desired amount of the droplet 271 from between the pair of gears 791 at a desired velocity.

Figure 17B:
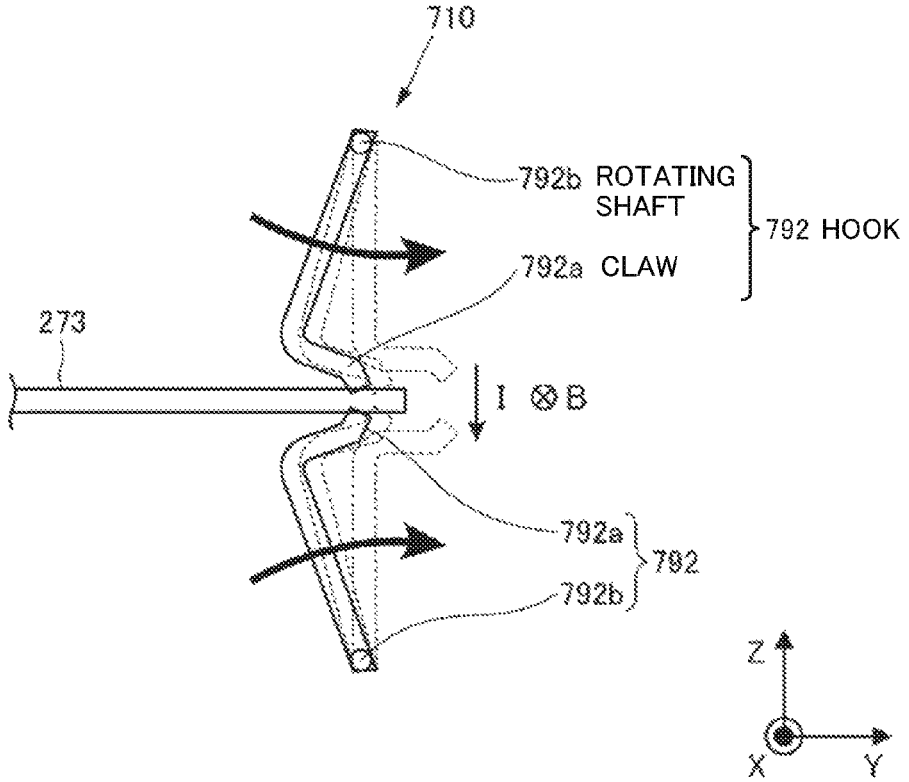
FIG. 17B is a drawing explaining a modification of the tenth example of the target supply apparatus.

FIG. 17B is a drawing explaining a modification of the tenth example of the target supply apparatus 26. The pair of electrodes 710 of the modification of the tenth example of the target supply apparatus 26 may be formed with a pair of hooks 792, instead of the pair of gears 791.

The target wire 273 transferred to between the pair of hooks 792 may be pinched between claws 792*a* of the pair of hooks 792. The area of the contact between the pair of hooks 792 and the target 27 sandwiched between the pair of hooks 792 may be small. Each of the pair of hooks 792 may be rotatably attached to a rotation shaft 792*b* with play. The pair of hooks 792 may be rotated in a rotational direction to feed the target 27 toward the direction in which the target 27 is ejected.

The pair of hooks 792 may be rotated by the Lorentz force as a driving force, which is induced by the current flowing to the target 27 sandwiched between the hooks 792 and the magnetic field applied to the target 27. The pair of hooks 792 may be rotated by the Lorentz force as a driving force, which is induced by the current flowing to the target 27 and the external magnetic field applied to the target 27 by the magnetic field generation device 76. The rotation of the hooks 792 may be controlled by the target controller 75 which controls the operation of the magnetic field generation device 76 configured to generate the external magnetic field.

When the target wire 273 which is the solid target 27 is transferred to between the pair of hooks 792, the pair of hooks 792 may pinch the target wire 273 with the claws 792*a* while being rotated. The solid target 27 transferred to between the pair of hooks 792 may be sandwiched between the hooks 792 while being pushed against the claws 792*a*. A constant current may be supplied to the solid target 27 sandwiched between the pair of hooks 792. The area of the contact between the target 27 and the hooks 792 is small, and therefore the heat generated in the portion of the target 27 in contact with the hooks 792 may not be easy to be diffused to the hooks 792. Accordingly, the target 27 being pushed against the claws 792*a* may be molten to the core.

The magnetic field generation device 76 may generate an external magnetic field having a constant intensity between the pair of hooks 792 in synchronization with the timing at which the target 27 sandwiched between the pair of hooks 792 is molten to the core. The Lorentz force induced by the external magnetic field may be applied to the target 27 sandwiched between the pair of hooks 792. At the same time, the Lorentz force induced by the external magnetic field may be applied to the hooks 792. The hooks 792 may be rotated by the Lorentz force in the direction in which the target 27 is ejected. When the pair of hooks 792 is rotated, the claws 792*a* of the hooks 792 may be guided to reduce the distance between the hooks 792. The target 27 sandwiched between the hooks 792 may be pushed against the claws 792*a* guided by the rotation of the hooks 792. Meanwhile, the molten front end of the target 27 may be separated from the remaining unmolten part of the target 27. The area of the contact between the target 27 and the hooks 792 is small, and therefore the molten front end of the target 27 may not be easy to adhere to the hooks 792 and to reduce its volume. As a result, it is possible to separate a constant volume of the target 27. A constant Lorentz force may be applied to the separated target 27. The target 27 may form the droplet 271 and be smoothly ejected from between the hooks 792 at a constant velocity. In addition, it is possible to prevent only the portion of the target 27 in contact with the hooks 792 from being jetted in a mist form.

The modification of the tenth example of the target supply apparatus 26 can melt the target 27 sandwiched between the pair of hooks 792 to the core, and smoothly eject the molten target 27 as a desired volume of the droplet 271 from between the hooks 792 at a desired velocity, in the same way as the tenth example of the target supply apparatus 26.

The other configuration of the target supply apparatus 26 according to Embodiment 5 may be the same as the configuration of the target supply apparatus 26 shown in FIGS. 1 to 16B.

10. Target Supply Apparatus According to Embodiment 6

Now, with reference to FIGS. 18A and 18B, the target supply apparatus 26 according to Embodiment 6 will be described. The constituent materials of the target 27 and the target supply apparatus 26 according to Embodiment 6 may be different from those of the target 27 and the target supply apparatus 26 according to Embodiments 1 to 5 shown in FIGS. 1 to 17B. The configuration of the target supply apparatus 26 according to Embodiment 6, which is the same as that of the target supply apparatus 26 shown in FIGS. 1 to 17B, will not be described again here. An example of the target supply apparatus 26 according to Embodiment 6 will be described as the eleventh example.

10.1 Eleventh Example of the Target Supply Apparatus

Now, with reference to FIG. 18A, the eleventh example of the target supply apparatus 26 will be described. FIG. 18A is a drawing explaining constituent materials of the target 27 which is supplied by the eleventh example of the target supply apparatus 26. FIG. 18B is a drawing explaining constituent materials of the pair of electrodes 710 of the eleventh example of the target supply apparatus 26.

According to the eleventh example, the constituent material of the target 27 may be a material having a higher melting point than that of the target 27 which emits the EUV light 251 having a wavelength of about 13 nm upon being irradiated with the pulsed laser beam 33. The constituent material of the target 27 which emits the EUV light 251 having a wavelength of about 13 nm upon being irradiated with the pulsed laser beam 33 may be, for example, tin. According to the eleventh example, the constituent material of the target 27 may be a material having a higher melting point than that of, for example, tin. According to the eleventh example, the constituent material of the target 27 may be a material that allows the target 27 to emit the EUV light 251 having a wavelength of about 6 nm upon being irradiated with the pulsed laser beam 33. According to the eleventh example, the constituent material of the target 27 may be a material shown in FIG. 18A, or a material with combination of any two or more of them.

According to the eleventh example, the constituent material of the pair of electrodes 710 may be a material suitable for the target 27 that emits the EUV light 251 having a wavelength of about 6 nm upon being irradiated with the pulsed laser beam 33. According to the eleventh example, the constituent material of the pair of electrodes 710 may be a material having a higher melting point than that of the target 27 according to the eleventh example. According to the eleventh example, it is preferred that the constituent material of the pair of electrodes 710 is a paramagnetic material or a ferromagnetic material. According to the eleventh example, the constituent material of the pair of electrodes 710 may be a material shown in FIG. 18B, or a material with combination of any two or more of them. According to the eleventh example, preferably, the constituent material of the pair of electrodes 710 may be a material shown in FIG. 18B except copper and aluminum, or a material with combination of any two or more of the materials shown in FIG. 18B except copper and aluminum.

The other configuration of the target supply apparatus 26 according to Embodiment 6 may be the same as the configuration of the target supply apparatus 26 shown in FIGS. 1 to 17B.

Figure 19:
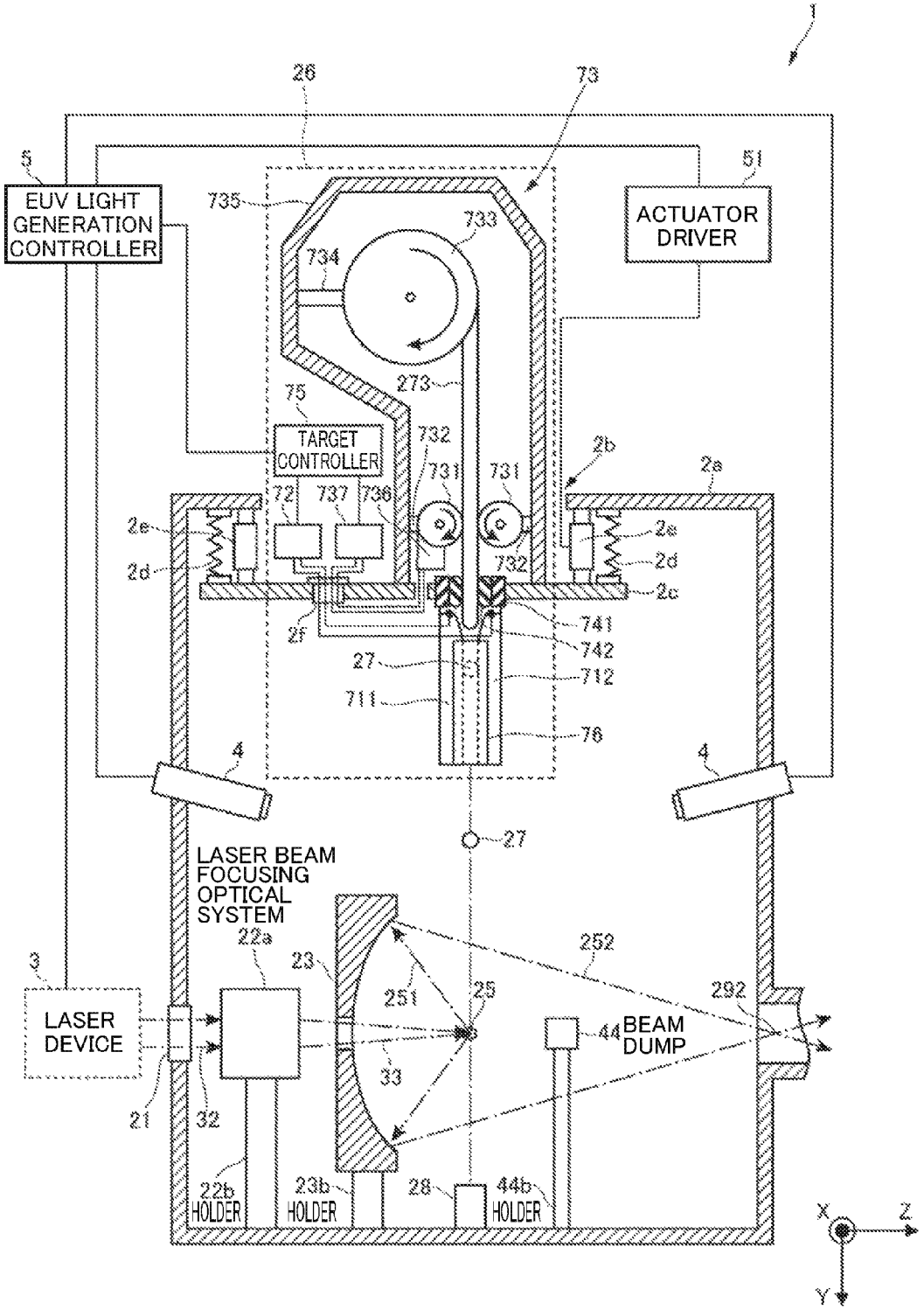
FIG. 19 is a drawing explaining an EUV light generating apparatus including the target supply apparatus.

11. EUV Light Generating Apparatus Including the Target Supply Apparatus 11.1 Configuration Now, with reference to FIG. 19, the EUV light generating apparatus 1 including the above-described target supply apparatus 26 will be described. FIG. 19 is a drawing explaining the EUV light generating apparatus 1 including the target supply apparatus 26. The configuration of the EUV light generating apparatus 1 shown in FIG. 19, which is the same as the configuration of the EUV light generating apparatus 1 shown in FIGS. 1 and 4 and includes the configuration of the target supply apparatus 26 shown in FIGS. 1 to 18B, will not be described again here.

As described above, the EUV light generating apparatus 1 includes the chamber 2, the actuators 2*e*, the flexible pipe 2*d*, the target supply apparatus 26, the target sensors 4, the EUV light generation controller 5, and the actuator driver 51. In addition to them, the EUV light generating apparatus 1 may include the following components. The EUV light generating apparatus 1 may include a laser beam focusing optical system 22*a*, the EUV collector mirror 23, the target collector 28, a beam dump 44, a holder 22*b*, a holder 23*b* and a holder 44*b*, which are provided in the chamber 2.

The laser beam focusing optical system 22*a* may include at least one mirror. The laser beam focusing optical system 22*a* may include at least one lens. The laser beam focusing optical system 22*a* may be held by the holder 22*b* to have a position and a posture that allow the pulsed laser beam 32 having entered the laser beam focusing optical system 22*a* via the window 21 to be focused on the plasma generation region 25.

The beam dump 44 may be held by the holder 44*b* such that the beam dump 44 is located on the extension of the optical path of the pulsed laser beam 33 focused by the laser beam focusing optical system 22*a*.

The target collector 28 may be disposed on the extension of the traveling path of the target 27 in the chamber 2.

The EUV collector mirror 23 may be held by the holder 23*b* to focus the EUV light 251 generated in the plasma generation region 25 onto the IF point 292.

The plurality of target sensors 4 may be provided on the wall 2*a* of the chamber 2. The plurality of target sensors 4 may observe the target 27 outputted into the chamber 2, from different two directions. The plurality of target sensors 4 may detect a timing at which the target 27 passes through a predetermined position between the target supply apparatus 26 and the plasma generation region 25. The plurality of target sensors 4 may detect a position through which the target 27 passes, located between the target supply apparatus 26 and the plasma generation region 25. The position at which the target 27 passes through may be observed on a plane orthogonal to an expected trajectory of the target 27 from the target supply apparatus 26 to the plasma generation region 25 at a predetermined position. The plurality of target sensors 4 may output the detected information to the EUV light generation controller 5.

The EUV light generation controller 5 may send/receive various signals to/from the exposure device 6. For example, the exposure device 6 may send an EUV light output command signal that commands to output the EUV light 252, to the EUV light generation controller 5. The EUV light output command signal may contain information, such as a targeted timing to output the EUV light 252, a targeted repetition frequency, and a targeted pulse energy. The EUV light generation controller 5 may totally control the operation of each of the components of the EUV light generating apparatus 1, based on the various signals sent from the exposure device 6.

The EUV light generation controller 5 may be connected to the laser device 3. The EUV light generation controller 5 may control the timing at which the laser device 3 performs an oscillation operation. The EUV light generation controller 5 may be connected to the laser beam focusing optical system 22*a*. The EUV light generation controller 5 may cause the laser beam focusing optical system 22*a* to control the traveling direction and the focused position of the pulsed laser beam. The EUV light generation controller 5 may be connected to the actuator driver 51. The EUV light generation controller 5 may cause the actuator driver 51 to control the position, the traveling path and so forth of the target 27 outputted from the target supply apparatus 26.

The EUV light generation controller 5 may be connected to the target controller 75. The EUV light generation controller 5 may cause the target controller 75 to control the output timing, the output frequency, the velocity, the volume and so forth of the target 27 outputted from the target supply apparatus 26. For example, the EUV light generation controller 5 may output a target output command signal that commands to output the target 27, to the target controller 75. The EUV light generation controller 5 may generate the target output command signal, based on an EUV light output command signal. The target output command signal may contain information such as a targeted output timing, a targeted output frequency, a targeted velocity, a targeted volume and so forth of the target 27.

11.2 Operation

The EUV light generation controller 5 may receive the EUV light output command signal sent from the exposure device 6. The EUV light generation controller 5 may output the target output command signal that commands to output the target 27, to the target controller 75, based on the EUV light output command signal.

The target controller 75 may control the operation of each of the components of the target supply apparatus 26, based on the target output command signal. The target supply apparatus 26 may output the target 27 which satisfies the various targeted values contained in the target output command signal, into the chamber 2, according to the control of the target controller 75.

In particular, as described above with reference to FIG. 4A, the target controller 75 may detect a change in the voltage between the pair of electrodes 710, based on the voltage detection signal outputted from the power source 72. The target controller 75 may control the timing and the amount of the current supplied to between the electrodes 710, and the timing and the amount of the target wire 273 transferred to between the electrodes 710, based on the detected change in the voltage and the target output command signal. For example, the target controller 75 may calculate the output frequency of the target 27, based on the change in the voltage value contained in the voltage detection signal. The target controller 75 may calculate a difference between the calculated output frequency of the target 27 and the targeted output frequency contained in the targeted output command signal. The target controller 75 may appropriately correct the timing and the amount of the target wire 273 to be transferred, if the difference is out of an allowable range.

Moreover, the target controller 75 may determine the state of the target 27 sandwiched between the pair of electrodes 710, based on the voltage detection signal outputted from the power source 72. For example, when the voltage value contained in the voltage detection signal is substantially the same as the value of the voltage applied from the power source 72 to the electrodes 710, the target controller 75 may determine the state of the target 27 as follows. That is, the target controller 75 may determine the state of the target as: the target wire 273 has not been transferred to between the electrodes 710; or the target 27 has already been ejected from between the electrodes 710.

Meanwhile, when the voltage value contained in the voltage detection signal is lower than the value of the voltage applied from the power source 72 to the electrodes 710, the target controller 75 may determine that the target 27 is sandwiched between the electrodes 710. In this case, the voltage value contained in the voltage detection signal outputted when the target 27 sandwiched between the electrodes 710 is molten may be greater than the voltage value outputted when the target 27 is in a solid state. Moreover, the voltage value contained in the voltage detection signal outputted when the target 27 sandwiched between the electrodes 710 is molten and accelerating may be greater than the voltage value outputted before the target 27 is accelerated. The target controller 75 may determine the state of the target 27, depending on the magnitude of the voltage value contained in the voltage detection signal. As described above with reference to FIG. 7, the target controller 75 may control the timing and amount of the current supplied to the target 27, the timing at which the external magnetic field is generated, and the intensity of the external magnetic field, depending on the state of the target 27.

The target sensors 4 may detect a timing at which the target 27 passes through a predetermined position in the chamber 2, and a position through which the target 27 passes, at a predetermined position in the chamber 2. The target sensors 4 may output the detected data of information to the EUV light generation controller 5.

The EUV light generation controller 5 may calculate the arrival position of the target 27 in the plasma generation region 25, based on the information of the position through which the target passes. The EUV light generation controller 5 may calculate a difference between the calculated arrival position of the target 27 and the position of the plasma generation region 25. If the difference is out of an allowable range, the EUV light generation controller 5 may output a control signal to the actuator driver 51 to correct the position and the posture of the target supply apparatus 26. As described above with reference to FIG. 4A, the actuator driver 51 may output the driving signal corresponding to the control signal to the actuators 2*e* to drive the actuators 2*e*. By this means, it is possible to adjust the traveling path of the target 27 supplied from the target supply apparatus 26, so that the target 27 can reach the plasma generation region 25.

The EUV light generation controller 5 may calculate the output frequency of the target 27, based on the information of the timings of the passage of a plurality of targets 27. The EUV light generation controller 5 may calculate a difference between the calculated output frequency of the target 27 and the targeted repetition frequency of the EUV light 252 contained in the EUV light output command signal. If the difference is out of an allowable range, the EUV light generation controller 5 may modify the targeted output frequency of the target 27 contained in the target output command signal.

In addition, the EUV light generation controller 5 may calculate the timing at which the target 27 reaches the plasma generation region 25, based on the information of the timing of the passage of the target 27. The EUV light generation controller 5 may control the timing at which the laser device 3 performs an oscillation operation, to focus the pulsed laser beam 33 on the plasma generation region 25 at the calculated timing at which the target 27 reaches the plasma generation region 25. The laser device 3 may oscillate the pulsed laser beam 31, based on the control of the EUV light generation controller 5 to control the timing at which the laser device 3 performs the oscillation operation. By this means, it is possible to irradiate the target 27 reaching the plasma generation region 25 with the pulsed laser beam 33. The target 27 irradiated with the pulsed laser beam 33 may be turned into plasma, and emit the EUV light 251. The EUV light 251 may be collected by the EUV collector mirror 23 and outputted to the exposure device 6 as the EUV light 252.

With the above-described configuration, it is possible to control the output frequency of the target 27 and the arrival position of the target 27 in the plasma generation region 25 by feedback control. Therefore, it is possible to generate the EUV light 251 in the plasma generation region 25 at a predetermined repetition frequency.

12. Others 12.1 Hardware Environment of Each Controller

A person skilled in the art would understand that the subject matters disclosed herein can be implemented by combining a general purpose computer or a programmable controller with a program module or a software application. In general, the program module includes routines, programs, components and data structures which can execute the processes disclosed herein.

Figure 20:
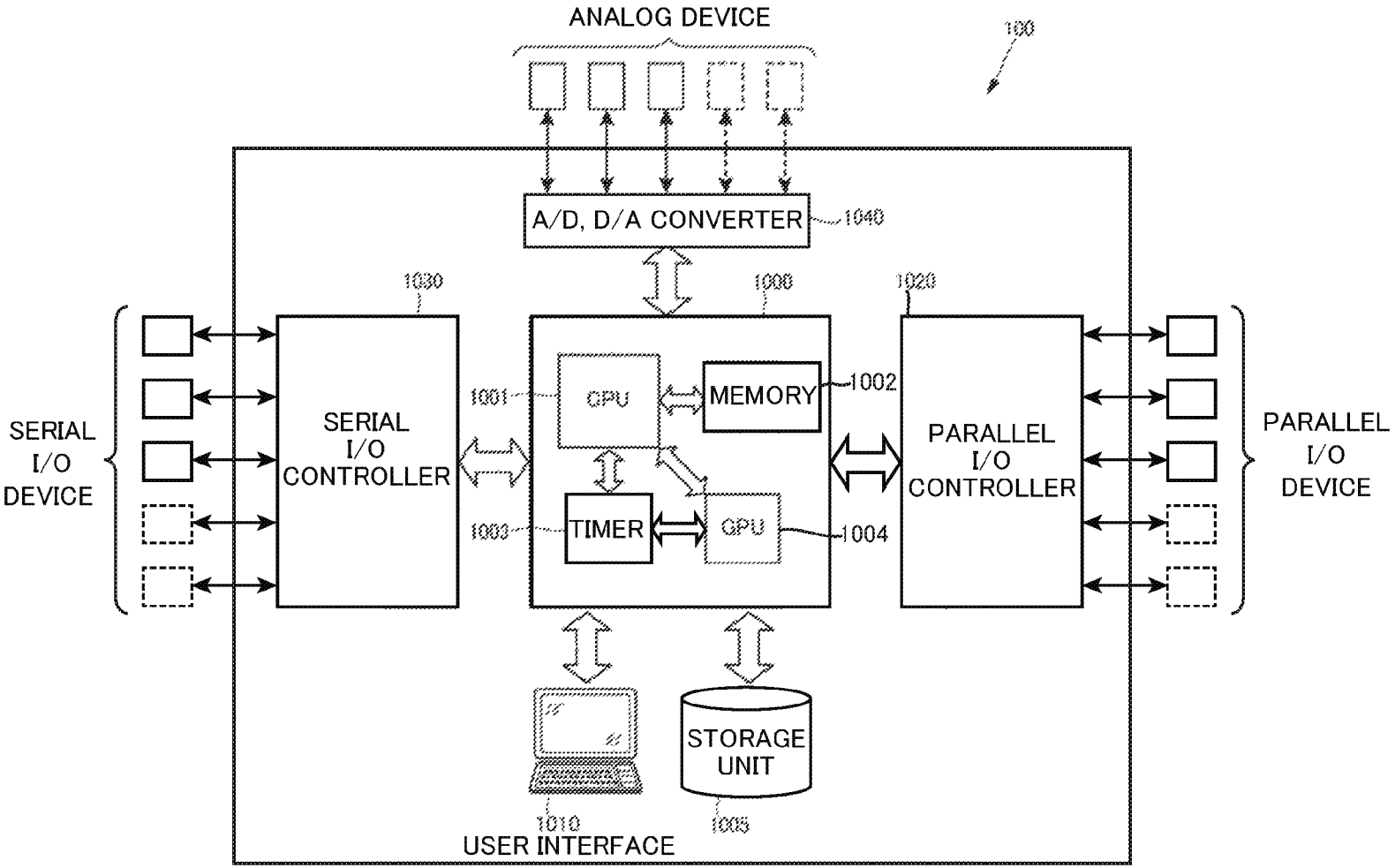
FIG. 20 is a block diagram showing a hardware environment of each controller.

FIG. 20 is a block diagram showing an exemplary hardware environment in which various aspects of the subject matters disclosed herein can be implemented. An exemplary hardware environment 100 shown in FIG. 20 may include a processing unit 1000, a storage unit 1005, a user interface 1010, a parallel I/O controller 1020, a serial I/O controller 1030, and an A/D, D/A converter 1040, but the configuration of the hardware environment 100 is not limited to this.

The processing unit 1000 may include a central processing unit (CPU) 1001, a memory 1002, a timer 1003, and a graphics processing unit (GPU) 1004. The memory 1002 may include a random access memory (RAM) and a read only memory (ROM). The CPU 1001 may be any of commercially available processors. A dual microprocessor or another multiprocessor architecture may be used as the CPU 1001.

The components shown in FIG. 20 may be interconnected with each other to perform the processes described herein.

During its operation, the processing unit 1000 may read and execute the program stored in the storage unit 1005, read data together with the program from the storage unit 1005, and write the data to the storage unit 1005. The CPU 1001 may execute the program read from the storage unit 1005. The memory 1002 may be a work area in which the program executed by the CPU 1001 and the data used in the operation of the CPU 1001 are temporarily stored. The timer 1003 may measure a time interval and output the result of the measurement to the CPU 1001 according to the execution of the program. The GPU 1004 may process image data according to the program read from the storage unit 1005, and output the result of the process to the CPU 1001.

The parallel I/O controller 1020 may be connected to parallel I/O devices that can communicate with the processing unit 1000, such as the EUV light generation controller 5, the target controller 75, the motor driver 737, and the actuator driver 51. The parallel I/O controller 1020 may control the communication between the processing unit 1000 and those parallel I/O devices. The serial I/O controller 1030 may be connected to serial I/O devices that can communicate with the processing unit 1000, such as the actuators 2*e*, the heaters 715, the power source 72, the motor 736, the magnetic field generation power source 762, the magnetic field shield driving part 766, the driving device for the pushing mechanism 78, and the driving device for the gears 791. The serial I/O controller 1030 may control the communication between the processing unit 1000 and those serial I/O devices. The A/D, D/A converter 1040 may be connected to analog devices such as the temperature sensor, the pressure sensor, various sensors for a vacuum gauge, the target sensor 4, and the current monitor 77 via analog ports, may control the communication between the processing unit 1000 and those analog devices, and may perform A/D, D/A conversion of the contents of the communication.

The user interface 1010 may present the progress of the program executed by the processing unit 1000 to an operator, in order to allow the operator to command the processing unit 1000 to stop the program or to execute an interruption routine.

The exemplary hardware environment 100 may be applicable to the EUV light generation controller 5, the target controller 75, the motor driver 737 and the actuator driver 51 in the present disclosure. A person skilled in the art would understand that those controllers may be realized in a distributed computing environment, that is, an environment in which tasks are performed by the processing units connected to each other via a communication network. In this disclosure, the EUV light generation controller 5, the target controller 75, the motor driver 737 and the actuator driver 51 may be connected to each other via a communication network such as Ethernet or Internet. In the distributed computing environment, the program module may be stored in both of a local memory storage device and a remote memory storage device.

12.2 Other Modification

It would be obvious to a person skilled in the art that the technologies described in the above-described embodiments including the modifications may be compatible with each other.

The descriptions above are intended to be illustrative only and the present disclosure is not limited thereto. Therefore, it will be apparent to those skilled in the art that it is possible to make modifications to the embodiments of the present disclosure within the scope of the appended claims.

The terms used in this specification and the appended claims should be interpreted as "non-limiting." For example, the terms "include" or "be included" should be interpreted as "including the stated elements but not limited to the stated elements." The term "have" should be interpreted as "having the stated elements but not limited to the stated elements." Further, the indefinite article "a/an" should be interpreted as "at least one" or "one or more."

REFERENCE SIGNS LIST

1 EUV light generating apparatus
2 chamber
26 target supply apparatus
27 target
5 EUV light generation controller
710 electrode
711*c*, 712*c* contact surface
718 groove
72 power source
75 target controller
76 magnetic field generation device
764 magnet
765 magnetic field shield
781 cam
785 elastic body
791 gear
792 hook

The invention claimed is:

1. A target supply apparatus configured to melt a target and supply a molten target into a chamber, the target generating extreme ultraviolet light when the target is irradiated with a laser beam in the chamber, the target supply apparatus comprising:

a pair of electrodes spaced from one another and configured to sandwich the target; and a power source configured to supply a current to a solid target sandwiched between the pair of electrodes via the pair of electrodes to melt the solid target to a core of the solid target, wherein contact surfaces of the pair of electrodes in contact with the target sandwiched between the pair of electrodes are made of a conductive material which resists chemical reaction between the contact surfaces and the target, resists adsorption of the target to the contact surfaces, and has a contact angle equal to or smaller than 90 degrees with the molten target.

2. The target supply apparatus according to claim 1, wherein a temperature of the pair of electrodes is maintained to be higher than a temperature of the core of the solid target sandwiched between the pair of electrodes.

3. The target supply apparatus according to claim 2, wherein the temperature of the pair of electrodes is maintained to be higher than a melting point of the target.

4. The target supply apparatus according to claim 2, wherein the pair of electrodes is made of a material having a lower heat conductivity than a heat conductivity of the solid target.

5. The target supply apparatus according to claim 2, wherein the pair of electrodes has a smaller heat capacity than a heat capacity of the solid target sandwiched between the pair of electrodes.

6. The target supply apparatus according to claim 1, further comprising:

a magnetic field generation device configured to generate a magnetic field between the pair of electrodes; and a target controller configured to control the magnetic field generation device, based on whether or not the solid target sandwiched between the pair of electrodes is molten to the core.

7. The target supply apparatus according to claim 6, wherein the target controller determines whether or not the solid target sandwiched between the pair of electrodes is molten to the core, based on the current supplied from the power source.

8. The target supply apparatus according to claim 6, wherein the target controller controls the magnetic field generation device to generate the magnetic field between the pair of electrodes in synchronization with a timing at which the solid target sandwiched between the pair of electrodes is molten to the core.

9. The target supply apparatus according to claim 6, wherein the magnetic field generation device includes:

a magnet configured to generate a magnetic field between the pair of electrodes; and a magnetic field shield disposed to be able to shield the target sandwiched between the pair of electrodes from the magnetic field generated by the magnet, and wherein the target controller controls the magnet field shield such that the magnetic field generated by the magnet is applied to the solid target in synchronization with a timing at which the solid target sandwiched between the pair of electrodes is molten to the core.

10. The target supply apparatus according to claim 6, wherein:

the molten target sandwiched between the pair of electrodes is ejected from between the pair of electrodes by a Lorentz force induced by the current supplied to the target and by the magnetic field applied to the target;

the magnetic field generation device generates an alternating current magnetic field between the pair of electrodes; and the target controller controls the magnetic field generation device such that a direction of the Lorentz force induced by the alternating current magnetic field matches a direction in which the molten target is ejected.

11. The target supply apparatus according to claim 1, wherein the molten target sandwiched between the pair of electrodes is pushed against contact surfaces of the pair of electrodes in contact with the molten target.

12. The target supply apparatus according to claim 11, wherein the pair of electrodes is provided with a cam configured to push the contact surfaces toward a direction in which a distance between the pair of electrodes is reduced.

13. The target supply apparatus according to claim 11, wherein the pair of electrodes is provided with elastic bodies configured to push the contact surfaces toward a direction in which a distance between the pair of electrodes is reduced.

14. The target supply apparatus according to claim 11, wherein:

the molten target sandwiched between the pair of electrodes is ejected from between the pair of electrodes by a Lorentz force induced by the current supplied to the target and the magnetic field applied to the target; and a distance between the pair of electrodes is reduced along a direction in which the molten target is ejected.

15. A target supply apparatus configured to melt a target and supply a molten target into a chamber, the target generating extreme ultraviolet light when the target is irradiated with a laser beam in the chamber, the target supply apparatus comprising:

a pair of electrodes spaced from one another and configured to sandwich the target; and a power source configured to supply a current to a solid target sandwiched between the pair of electrodes via the pair of electrodes to melt the solid target to a core of the solid target, wherein:

the molten target sandwiched between the pair of electrodes is pushed against contact surfaces of the pair of electrodes in contact with the molten target: and grooves are formed in the contact surfaces of the pair of electrodes.

16. A target supply apparatus configured to melt a target and supply a molten target into a chamber, the target generating extreme ultraviolet light when the target is irradiated with a laser beam in the chamber, the target supply apparatus comprising:

a pair of electrodes spaced from one another and configured to sandwich the target; and a power source configured to supply a current to a solid target sandwiched between the pair of electrodes via the pair of electrodes to melt the solid target to a core of the solid target, wherein the pair of electrodes rotate to eject the molten target sandwiched between the pair of electrodes from between the pair of electrodes.

17. The target supply apparatus according to claim 16, wherein the pair of electrodes are formed with a pair of gears.

18. The target supply apparatus according to claim 16, wherein the pair of electrodes is rotated by a Lorentz force induced by the current supplied to the target sandwiched between the pair of electrodes and the magnetic field applied to the target.

19. An extreme ultraviolet light generating apparatus including the target supply apparatus according to claim 1.

* * * * *